US008494383B2

(12) United States Patent
Shimura et al.

(10) Patent No.: US 8,494,383 B2
(45) Date of Patent: Jul. 23, 2013

(54) IMAGE FORMING APPARATUS CONTROLLING POWER FROM A COMMERCIAL AC POWER SUPPLY TO A HEATER AND DETECTING CURRENT FLOWING IN A POWER SUPPLY PATH FROM THE COMMERCIAL AC POWER SUPPLY TO THE HEATER

(75) Inventors: Yasuhiro Shimura, Yokohama (JP); Kei Sato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 440 days.

(21) Appl. No.: 12/789,646

(22) Filed: May 28, 2010

(65) Prior Publication Data

US 2010/0310267 A1 Dec. 9, 2010

(30) Foreign Application Priority Data

Jun. 8, 2009 (JP) ..... 2009-137149
Apr. 28, 2010 (JP) ..... 2010-103763

(51) Int. Cl.
*G03G 15/00* (2006.01)

(52) U.S. Cl.
USPC ..... 399/37; 399/67

(58) Field of Classification Search
USPC ..... 399/37, 33, 67, 69; 219/216
See application file for complete search history.

(56) References Cited

U.S. PATENT DOCUMENTS

| | | | | |
|---|---|---|---|---|
| 5,994,671 | A * | 11/1999 | Suzuki et al. | 219/216 |
| 6,853,818 | B2 | 2/2005 | Nishida | |
| 7,076,183 | B2 | 7/2006 | Kawazu et al. | |
| 7,139,500 | B2 | 11/2006 | Kawazu et al. | |
| 7,187,882 | B2 | 3/2007 | Kawazu et al. | |
| 7,630,662 | B2 | 12/2009 | Namiki et al. | |
| 2006/0078344 | A1 * | 4/2006 | Kawazu et al. | 399/69 |
| 2009/0003868 | A1 * | 1/2009 | Namiki et al. | 399/69 |

FOREIGN PATENT DOCUMENTS

EP 0 797 130 9/1997

(Continued)

OTHER PUBLICATIONS

European Search Report dated Oct. 1, 2010, in European Application No. 10165082.8-2209.

(Continued)

*Primary Examiner* — G. M. Hyder
(74) *Attorney, Agent, or Firm* — Fitzpatrick, Cella, Harper & Scinto

(57) ABSTRACT

Part of a plurality of power levels of control patterns selected to control power supplied from an AC power source to a heater of an image forming apparatus include power levels of a) waveforms in which power is supplied in part of negative and positive half cycles in order after no power supply during a one half of a positive half cycle, and waveforms in which power is supplied in part of a positive cycle after no power supply during one half of a negative half cycle, or b) waveforms in which power is supplied in part of positive and negative half cycles in order after no power supply during one half of a negative half cycle, and waveforms in which power is supplied in part of a negative half cycle after no power supply during one half of a positive half cycle.

24 Claims, 24 Drawing Sheets

FOREIGN PATENT DOCUMENTS

| | | | |
|---|---|---|---|
| EP | 0797130 | A2 | 9/1997 |
| EP | 1 302 817 | | 4/2003 |
| JP | 10-010917 | | 1/1998 |
| JP | 2003-123941 | | 4/2003 |
| JP | 2004-226557 | | 8/2004 |
| JP | 2004-309518 | | 11/2004 |
| JP | 2007-264927 | | 10/2007 |

OTHER PUBLICATIONS

Chinese Office Action and English translation thereof in Chinese Application No. 201010198532.2 dated Sep. 8, 2011.

* cited by examiner

| | OUTPUT VALUE OF HCRRT SIGNAL (V) | | | | AVERAGE VALUE OF HCRRT SIGNAL IN ONE CONTROL PERIOD (V) | AVERAGE VALUE ERROR OF HCRRT SIGNAL IN ONE CONTROL PERIOD (%) | AVERAGE VALUE ERROR OF EFFECTIVE CURRENT VALUE IN ONE CONTROL PERIOD (%) |
|---|---|---|---|---|---|---|---|
| | HALF-WAVE [1] | HALF-WAVE [2] | HALF-WAVE [3] | HALF-WAVE [4] | | | |
| WAVE FORM 1 | 0.38 | 0.76 | 0.04 | 0.66 | 0.46 | -21.12 | 11.19 |
| WAVE FORM 2 | 0.34 | 1.00 | 0.00 | 1.00 | 0.58 | - | - |

| | OUTPUT VALUE OF HCRRT SIGNAL (V) | | | | AVERAGE VALUE OF HCRRT SIGNAL IN ONE CONTROL PERIOD (V) | AVERAGE VALUE ERROR OF HCRRT SIGNAL IN ONE CONTROL PERIOD (%) | AVERAGE VALUE ERROR OF EFFECTIVE CURRENT VALUE IN ONE CONTROL PERIOD (%) |
|---|---|---|---|---|---|---|---|
| | HALF-WAVE [1] | HALF-WAVE [2] | HALF-WAVE [3] | HALF-WAVE [4] | | | |
| WAVE FORM 3 | 0.38 | 0.01 | 1.21 | 0.50 | 0.52 | -10.29 | 5.28 |
| WAVE FORM 4 | 0.34 | 0.00 | 1.00 | 1.00 | 0.58 | - | - |

| | OUTPUT VALUE OF HCRRT SIGNAL (V) | | | | AVERAGE VALUE OF HCRRT SIGNAL IN ONE CONTROL PERIOD (V) | AVERAGE VALUE ERROR OF HCRRT SIGNAL IN ONE CONTROL PERIOD (%) | AVERAGE VALUE ERROR OF EFFECTIVE CURRENT VALUE IN ONE CONTROL PERIOD (%) |
|---|---|---|---|---|---|---|---|
| | HALF-WAVE [1] | HALF-WAVE [2] | HALF-WAVE [3] | HALF-WAVE [4] | | | |
| WAVE FORM 5 | 0.43 | 0.81 | 0.13 | 0.72 | 0.52 | −13.41 | 6.95 |
| WAVE FORM 6 | 0.37 | 1.00 | 0.05 | 1.00 | 0.60 | – | – |

| | OUTPUT VALUE OF HCRRT SIGNAL (V) | | | | AVERAGE VALUE OF HCRRT SIGNAL IN ONE CONTROL PERIOD (V) | AVERAGE VALUE ERROR OF HCRRT SIGNAL IN ONE CONTROL PERIOD (%) | AVERAGE VALUE ERROR OF EFFECTIVE CURRENT VALUE IN ONE CONTROL PERIOD (%) |
|---|---|---|---|---|---|---|---|
| | HALF-WAVE [1] | HALF-WAVE [2] | HALF-WAVE [3] | HALF-WAVE [4] | | | |
| WAVE FORM 7 | 0.43 | 0.09 | 1.15 | 0.59 | 0.56 | -6.49 | 3.30 |
| WAVE FORM 8 | 0.37 | 0.05 | 1.00 | 1.00 | 0.60 | - | - |

FIG. 21A
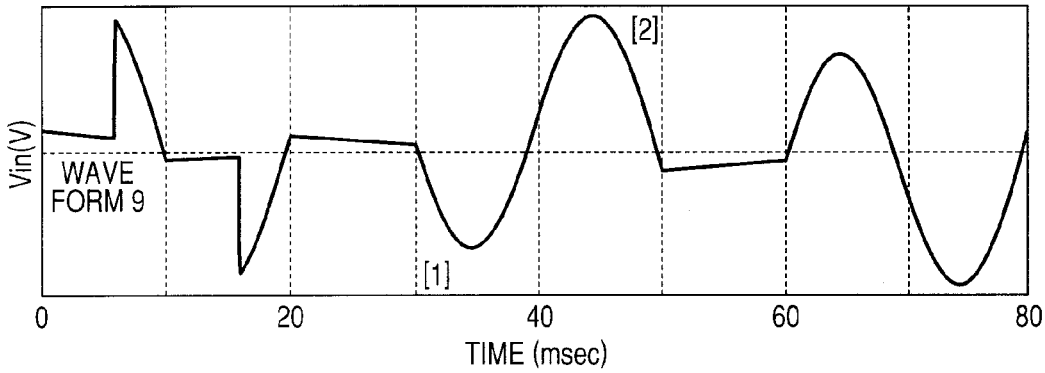
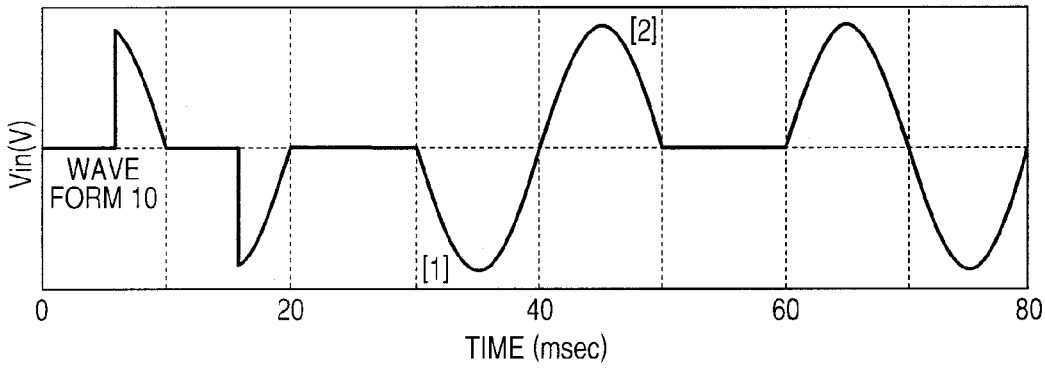
FIG. 21B
| | OUTPUT VALUE OF HCRRT SIGNAL (V) | | AVERAGE VALUE OF HCRRT SIGNAL (V) | CONVERTED AVERAGE VALUE OF HCRRT SIGNAL IN ONE CONTROL PERIOD (V) | AVERAGE VALUE ERROR OF HCRRT SIGNAL IN ONE CONTROL PERIOD (%) | AVERAGE VALUE ERROR OF EFFECTIVE CURRENT VALUE IN ONE CONTROL PERIOD (%) |
|---|---|---|---|---|---|---|
| | HALF-WAVE [1] | HALF-WAVE [2] | | | | |
| WAVE FORM 9 | 0.53 | 1.21 | 0.87 | 0.51 | -13.34 | 6.91 |
| WAVE FORM 10 | 1.00 | 1.00 | 1.00 | 0.58 | - | - |

| |
|---|
| FIG. 22A |
| FIG. 22B |

IMAGE FORMING APPARATUS CONTROLLING POWER FROM A COMMERCIAL AC POWER SUPPLY TO A HEATER AND DETECTING CURRENT FLOWING IN A POWER SUPPLY PATH FROM THE COMMERCIAL AC POWER SUPPLY TO THE HEATER

BACKGROUND OF THE INVENTION

1. Field of the Invention

The present invention relates to an image forming apparatus including a fixing part for fixing a toner image to a recording material.

2. Description of the Related Art

Conventionally, for an image forming apparatus, such as a copier or a laser beam printer, the following fixing apparatus has been used as a fixing apparatus for heating a toner image formed on a recording material and fixing the toner image thereto. For example, a heat-fixing apparatus of a heat-roller type which uses a halogen lamp as a heat source or a heat-fixing apparatus of a film heating type which uses a ceramic heater as a heat source is used.

In general, a heater is connected to an AC power supply via a switching element such as a triac, and is supplied with power by the AC power supply. The fixing apparatus is provided with a temperature detection element, for example, a thermistor temperature sensing element. The temperature of the fixing apparatus is detected by the temperature detection element. Then, based on detected temperature information, a central processing unit (CPU) performs on/off control on the switching element, to thereby turn on/off power supplied to the heater, which enables such temperature control that sets the temperature of the fixing apparatus to a target temperature. The on/off control of the heater is performed by one of phase control and wave number control.

The phase control method is a method of supplying power to the heater by turning on the heater at an arbitrary phase angle within one half-wave of an AC wave form. Meanwhile, the wave number control method is a power control method in which the heater is turned on/off in units of half-wave of the AC wave form. Most of conventional technologies use one of the phase control and the wave number control.

The reason for selecting phase control is possibly because flickering of a lighting apparatus, which is the phenomenon called flicker, may be suppressed. Flicker refers to the flickering of the lighting apparatus when the AC power supply generates voltage fluctuations due to fluctuations in a load current of an electrical apparatus connected to the same power supply as the lighting apparatus and an impedance of a distribution line. Phase control is such control that the switching element is turned on midway through one half-wave (phase angle ranging from 0° to 180°). Therefore, the change amount and the change period of the current are small, which may suppress the occurrence of the flicker. Meanwhile, wave number control is such control that the switching element is turned on at a zero-crossing point of the AC wave form. Therefore, the fluctuations in the current are larger than in phase control, and hence flicker is more likely to occur.

The reason for selecting wave number control is possibly because a harmonic current and switching noise may be suppressed. The harmonic current and switching noise are generated due to steep fluctuations in current caused when the heater is turned on/off. This is because the harmonic current and switching noise are generated to a smaller extent in wave number control in which the on/off control of the heater is always performed at the zero-crossing point than in the phase control in which switching is performed midway through the half-wave of the AC wave form. The harmonic current and switching noise tend to be generated to a larger extent with a higher voltage of the AC power supply being used.

It is therefore general to set a control method depending upon an AC commercial power supply voltage in a region in which the image forming apparatus is used. For example, the control of the heater is performed by choosing the phase control method effective for flicker for the region using an AC commercial power supply voltage of, for example, 100 V to 120 V. Meanwhile, the control of the heater is performed by choosing the wave number control method effective for the harmonic current and the switching noise for the region using an AC commercial power supply voltage of, for example, 220 V to 240 V. In such a manner, the control of the heater is generally fixed to one of the methods.

Further, there is a technology that proposes a method combining the phase control and the wave number control. For example, in Japanese Patent Application Laid-Open No. 2003-123941, a plurality of half-waves are set as one control period, partial half-waves of the one control period being subjected to the phase control and the remaining half-waves being subjected to the wave number control. This may prevent the generation of the harmonic current and the switching noise to a smaller extent than in the case of using only the phase control. In addition, flicker may be reduced to a lower level than in the case of using only wave number control, which allows multistage control of the power to the heater.

Here, a positive half-wave at which the power is supplied by one of the phase control and the wave number control is defined as a positive energization cycle, while a negative half-wave at which the power is supplied thereby is defined as a negative energization cycle. Further, a half-wave at which the power is not supplied is defined as a non-energization cycle. Further, one unit period for controlling the amount of power to be supplied to the heater by separating the amount by a fixed period is defined as one control period.

When controlling the temperature of the fixing apparatus, a sequence controller compares the temperature detected by the temperature detection element with the preset target temperature, and calculates a power duty (power ratio) of the above-mentioned heater. Then, the sequence controller determines one of the phase angle and the wave number corresponding to the power duty, and, under one of a phase condition and a wave number condition thereof, controls the on/off state of the switching element driving the heater.

However, a current supplied from the commercial power supply to the fixing apparatus needs to be controlled to a rated current (protection circuit) of the fixing apparatus and a current value equal to or less than the upper limit defined by Underwriters Laboratories Inc. (UL) or Electrical Appliance and Material Safety Law. Therefore, there is an apparatus for detecting a current flowing in the fixing apparatus and controlling the power supplied to the fixing apparatus so as not to exceed the upper limit value of the current that may be caused to flow. Hence, in recent years, printers increasingly need to be provided with a circuit for detecting the current flowing in the fixing apparatus.

Japanese Patent Application Laid-Open No. 2004-226557 and Japanese Patent Application Laid-Open No. 2004-309518 propose methods of detecting an effective current value on a half period basis by inputting a wave form obtained by voltage-transform by a current detection transformer into a current detection circuit via a resistor. In general, a secondary-side voltage wave form obtained by voltage-transform by the current detection transformer generates distortion due to the inherent characteristics of the element. When a distorted voltage wave form is input to the current detection circuit, the effective value of the wave form changes due to the distortion, which lowers detection precision of the current detection circuit. Note that, the amount of distortion generated in the current detection transformer varies depending upon the amplitude, the phase angle, and the frequency of a primary-side input wave form. In particular, if there is steep fluctuation in the load, the amount of distortion generated in the current detection transformer increases.

The power supplied to the heater is steadily increasing owing to the recent enhancement of printing speed. Further, the regulation of flicker, the regulation of a harmonic current, and other such regulation, which are becoming more stringent, are harder to comply with only by the conventional heater power control using one of the phase control and the wave number control. In contrast, the control method combining the phase control and the wave number control is effective.

However, particularly in the above-mentioned method combining the phase control and the wave number control, the fluctuation in load is larger than in the conventional phase control because the phase control and the wave number control are changed over in one control period, and hence it is difficult to detect a current with accuracy.

SUMMARY OF THE INVENTION

The present invention has been made under such circumstances, and an object thereof is to improve the accuracy of current detection.

Another object of the present invention is to provide an image forming apparatus, including a fixing part for heat-fixing an unfixed toner image formed on a recording material to the recording material. The fixing part comprises a heater that generates heat by power supplied from a commercial AC power supply. The apparatus also comprises a temperature sensing element for sensing a temperature of the fixing part, and a power control part for controlling the power supplied from the commercial AC power supply to the heater according to the temperature sensed by the temperature sensing element. The power control part sets a plurality of power ratios according to the sensed temperature per an one-control-period that is defined as a predetermined number of continuing half-waves in an AC wave form. The apparatus also comprises a current detection part provided in a power supply path from the commercial AC power supply to the heater, for detecting a current flowing in the power supply path. The current detection part comprises a transformer and a current detection circuit for detecting the current via the transformer. The a wave form corresponding to at least one power ratio among the plurality of power ratios includes: a first group in which a negative half-wave to turn on at least a part of a half-wave and a positive half-wave to turn on at least a part of a half-wave continue in order just after a half-wave to turn off an entirety of one half-wave, and a second group in which a positive half-wave to turn on at least a part of a half-wave continues just after a half-wave to turn off an entirety of one half-wave, or a first group in which a positive half-wave to turn on at least a part of a half-wave and a negative half-wave to turn on at least a part of a half-wave continue in order just after a half-wave to turn off an entirety of one half-wave, and a second group in which a negative half-wave to turn on at least a part of a half-wave continues just after a half-wave to turn off an entirety of one half-wave.

A further object of the present invention becomes apparent from the following detailed description with reference to the accompanying drawings.

BRIEF DESCRIPTION OF THE DRAWINGS

FIGS. 21A and 21B are diagrams illustrating and indicating simulation results of a heater current according to the third embodiment.

DESCRIPTION OF THE EMBODIMENTS

Hereinafter, exemplary embodiments according to the present invention are described in detail with reference to the accompanying drawings. However, components described in this embodiment are mere examples, and are not intended to limit the scope of the present invention unless otherwise specified.

First Embodiment (Structure of Image Forming Apparatus)

Figure 1:
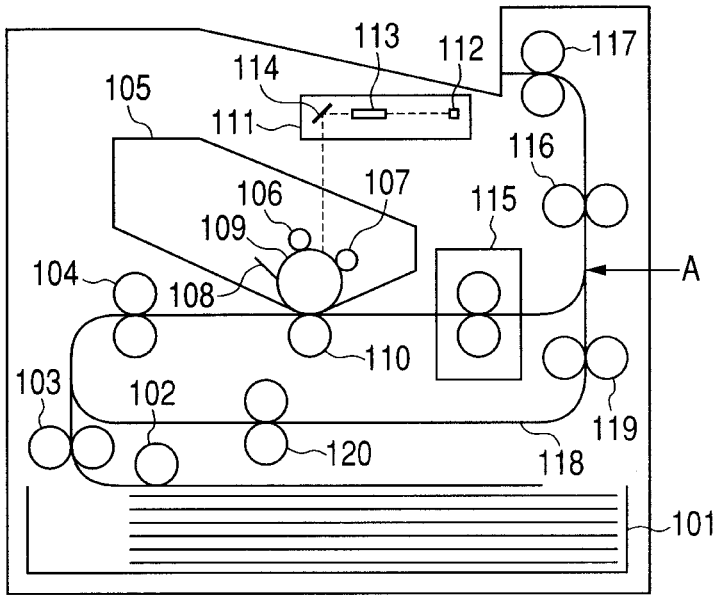
FIG. 1 is a configuration diagram of a printer according to first to third embodiments of the present invention.

FIG. 1 illustrates a structure of an image forming apparatus according to a first embodiment of the present invention. Only one of the recording materials stacked in a sheet feeding cassette 101 is sent from the sheet feeding cassette 101 by a pickup roller 102, and is conveyed toward registration rollers 104 by sheet feeding rollers 103. Further, the recording material is conveyed to a process cartridge 105 by the registration rollers 104 at a predetermined timing. The process cartridge 105 integrally includes a charger 106 serving as a charging unit, a developing roller 107 serving as a developing unit, a cleaner 108 serving as a cleaning unit, and a photosensitive drum 109 serving as an electronic photosensitive member. In the image forming apparatus having such a structure, an unfixed toner image is formed on the recording material by a series of process of a known electrophotographic process.

After the photosensitive drum 109 has a surface thereof uniformly charged by the charger 106, the photosensitive drum 109 is subjected to image exposure based on an image signal of a scanner unit 111 serving as an image exposure unit. A laser beam (dotted line) emitted from a laser diode 112 within the scanner unit 111 is caused to scan in a main scanning direction via a rotating polygon mirror 113 and a reflecting mirror 114, and in a sub scanning direction by rotation of the photosensitive drum 109. Note that, the main scanning direction is a direction perpendicular to the sub scanning direction in which the recording material is conveyed. A two-dimensional latent image is formed on the surface of the photosensitive drum 109 by the scanning of the laser beam. The latent image on the photosensitive drum 109 is visualized as a toner image by the developing roller 107, and is transferred by a transfer roller 110 onto the recording material conveyed from the registration rollers 104.

Subsequently, the recording material onto which the toner image has been transferred is conveyed to a fixing apparatus 115 to be subjected to a heat and pressure process, and the unfixed toner image on the recording material is fixed to the recording material. Further, the recording material is discharged to an outside of an image forming apparatus main body by intermediate sheet discharge rollers 116 and sheet discharge rollers 117, and the series of printing operation is brought to an end. Further, in a case of performing duplex printing, after a trailing end of the recording material passes through the fixing apparatus 115 and the point A of FIG. 1, rotation of a fixing motor (not shown) is reversed to cause the intermediate sheet discharge rollers 116 and the sheet discharge rollers 117 to rotate in their reverse directions. Therefore, the conveyance direction of the recording material is reversed so that the recording material is to be sent to an inside of a duplexing conveyance path 118. The recording material sent into the duplexing conveyance path 118 is conveyed again to the registration rollers 104 by duplexing conveyance rollers 119 and sheet refeeding rollers 120, and printing is performed on the second surface by the same sequence as described above.

(Structure of Fixing Apparatus)

Figure 2:
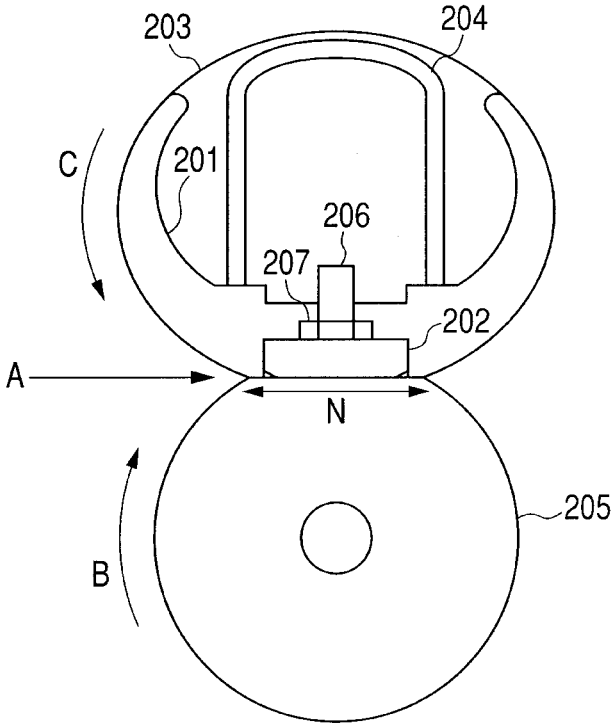
FIG. 2 is a configuration diagram of a fixing apparatus according to the first to third embodiments.

FIG. 2 is a sectional view of a schematic structure of the fixing apparatus 115. The fixing apparatus (fixing part) is a part for heat-fixing the unfixed toner image formed on the recording material to the recording material. The fixing part includes a heater that generates heat by power supplied from the commercial AC power supply. The fixing apparatus 115 according to this embodiment is an apparatus of a film heating type which uses a ceramic heater as a heat source. A heater holder 201 is a heat resistant/thermal insulating/rigid member for securing a ceramic heater and for guiding an inner surface of a film, and is a horizontally oriented member with the longitudinal direction (perpendicular to the surface of FIG. 2) crossing a conveyance path for the recording material. A ceramic heater 202 (hereinafter, referred to simply as "heater") is a horizontally oriented member with the longitudinal direction crossing the conveyance path for a transfer material, which is fitted into a groove portion formed along the longitudinal direction on a bottom surface of the heater holder 201 and fixedly supported by a heat-resistant adhesive. A heat-resistant film member (endless belt; hereinafter, referred to as "fixing film") 203 having a cylindrical shape is loosely fitted to an outer surface of the heater holder 201 having the heater 202 attached thereto. A stay 204 is a rigid member having the longitudinal direction perpendicular to the surface of FIG. 2, and is disposed to an inside of the heater holder 201.

The pressure roller 205 is located so as to nip the fixing film 203 with the heater 202 of the heater holder 201 in press contact with the fixing film 203. An area within a range indicated by the arrow N is a fixing nip portion formed by the press contact. The pressure roller 205 is driven by a fixing motor (not shown) to rotate in a direction indicated by the arrow B at a predetermined peripheral speed. A rotational force directly acts upon the fixing film 203 by a frictional force exerted by the pressure roller 205 and an outer periphery of the fixing film 203 in the fixing nip portion N. The fixing film 203 slides to a bottom surface of the heater 202 in press contact therewith while being driven to rotate in a direction indicated by the arrow C. The heater holder 201 functions as a member for guiding the inner surface of the fixing film 203, which facilitates the rotation of the fixing film 203. In addition, a small amount of lubricant, such as heat-resistant grease, may be caused to intervene between the inner surface of the fixing film 203 and the bottom surface of the heater 202 in order to reduce the sliding resistance therebetween.

After the rotation of the fixing film 203 driven by the rotation of the pressure roller 205 has become steady and the temperature of the heater 202 has risen to a predetermined value, the recording material to be subjected to the fixing operation is introduced into the fixing nip portion N between the fixing film 203 and the pressure roller 205, and is nipped and conveyed therethrough. The heater 202 applies heat to the unfixed image of the recording material thus conveyed via the fixing film 203. Then, the unfixed image on the recording material is heat-fixed to a surface of the recording material. The recording material that has passed through the fixing nip portion N is conveyed after being separated from an outer surface of the fixing film 203. Note that, the arrow A of FIG. 2 indicates the conveyance direction of the recording material.

Further, the fixing apparatus 115 includes a thermistor 206, which is a temperature sensing element for detecting the temperature of the heater 202. The thermistor 206 is abutted against the heater 202 by a spring or the like with a predetermined pressure, and detects the temperature of the heater 202. In addition, an excessive temperature protection element 207 is disposed on the heater 202 as a unit for preventing excessive temperature in a case where the heater 202 has reached a thermal runaway temperature due to a failure in a power supply control unit (hereinafter, referred to as, for example, "power supply control part"), which is a unit for controlling the power supplied to the heater 202. Examples of the excessive temperature protection element 207 include a thermal fuse and a thermoswitch. If the heater 202 has reached the thermal runaway temperature due to a failure in the power supply control part and if the temperature of the excessive temperature protection element 207 has risen to a predetermined value, the excessive temperature protection element 207 becomes open, thereby deenergizing the heater 202.

(Control of Power Supplied to Ceramic Heater)

Figure 3:
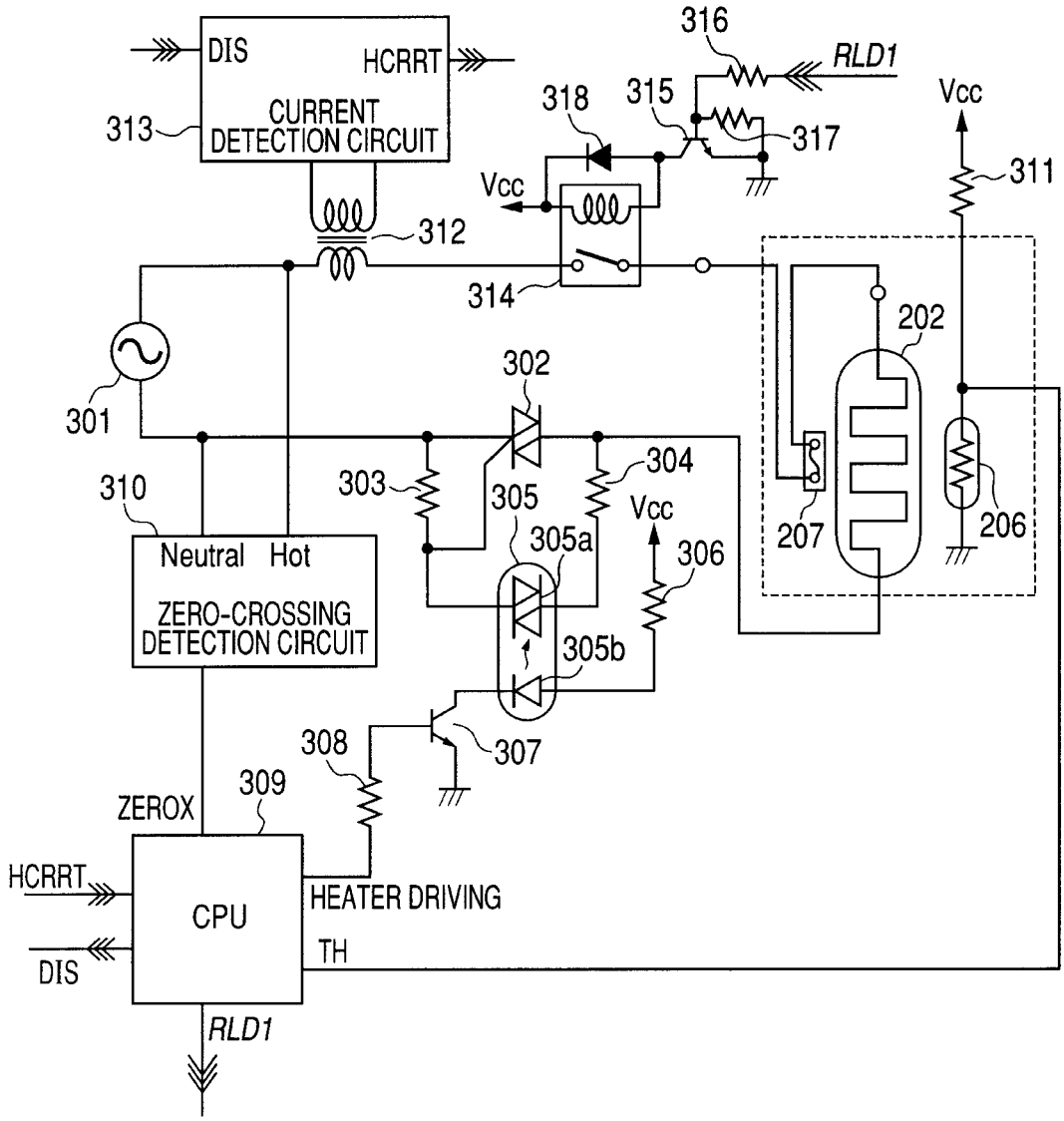
FIG. 3 is a configuration diagram of a heater driving circuit of the fixing apparatus according to the first embodiment.

FIG. 3 illustrates a driving circuit and a control circuit that are a power supply control part of the heater 202 according to this embodiment. The control circuit (power control part) controls the power supplied from the commercial AC power supply to the heater according to the temperature sensed by the temperature sensing element 206. In FIG. 3, the image forming apparatus supplies power from a commercial AC power supply 301 connected to the image forming apparatus to the heater 202, to thereby cause the heater 202 to generate heat. The power is supplied to the heater 202 by energization/deenergization by a triac 302. Resistors 303 and 304 are bias resistors for the triac 302. Further, a phototriac coupler 305 is a device for securing the creeping distance between the primary and the secondary, and includes a phototriac 305*a* and a light-emitting diode 305*b*. The light-emitting diode 305*b* of the phototriac coupler 305 is energized to thereby turn on the triac 302. A resistor 306 is a resistor for limiting a current flowing in the phototriac coupler 305. The phototriac coupler 305 is turned on/off by a transistor 307.

The transistor 307 operates according to a heater driving signal sent from a CPU 309 via a resistor 308. An input power supply voltage from the AC power supply 301 is also input to a zero-crossing detection circuit 310, which is a voltage wave form detection unit. The zero-crossing detection circuit 310 detects a zero-crossing point of the input power supply voltage, and outputs a zero-crossing signal (referred to as "ZEROX" in the figures) to the CPU 309. A current detection transformer 312 voltage-transforms a current caused to flow to the heater 202, and performs an input to a current detection circuit 313. The current detection circuit 313 converts a heater current wave form obtained by the voltage-transform into an effective value or a square value, and outputs a voltage value as an HCRRT signal. The CPU 309 detects a value obtained by A/D-converting the HCRRT signal. The temperature detected by the thermistor 206 is detected as a partial voltage between a resistor 311 and the thermistor 206, and outputs a voltage value as a TH signal. The CPU 309 detects a value obtained by A/D-converting the TH signal.

The temperature of the heater 202 is controlled as follows. The CPU 309 calculates a power ratio of the power to be supplied to the heater 202 by comparing the input TH signal and a set temperature prestored in the CPU 309. Then, the CPU 309 converts the power ratio of the power to be supplied into one of a corresponding phase angle (phase control), a corresponding wave number (wave number control), and a corresponding control level of a method combining the phase control and the wave number control described later. Under such a control condition, the CPU 309 outputs the heater driving signal (on signal) to the transistor 307. When calculating the power ratio of the power supplied to the heater 202, the CPU 309 calculates an upper limit power ratio corresponding to an upper limit current value based on the HCRRT signal notified from the current detection circuit 313, and performs control so that a power equal to or less than the upper limit power ratio is supplied to the heater 202.

In addition, the excessive temperature protection element 207 is disposed on the heater 202 as a unit for preventing the occurrence of excessive temperature in a case where the heater 202 has reached the thermal runaway temperature due to a failure in the power supply control unit of the heater 202. Examples of the excessive temperature protection element 207 include a thermal fuse and a thermoswitch. If the heater 202 has reached the thermal runaway temperature due to a failure in the power supply control part and if the temperature of the excessive temperature protection element 207 has risen to a predetermined value, the excessive temperature protection element 207 becomes open, thereby deenergizing the heater 202.

Further, an abnormally high temperature detection temperature is set aside from the set temperature for the temperature control. If the temperature detected as the temperature of the heater 202 from the TH signal input to the CPU 309 is equal to or higher than the abnormally high temperature detection temperature, the CPU 309 sets an RLD1 signal at a low level, turns off the transistor 315, and turns off a relay 314. In such a manner, the heater 202 is deenergized. A resistor 316 is a current limiting resistor, and a resistor 317 is a bias resistor between a base and an emitter of a transistor 315. A diode 318 is an element for absorbing a counter electromotive force when the relay 314 is in an off state.

(Zero-Crossing Detection Circuit)

Figure 4:
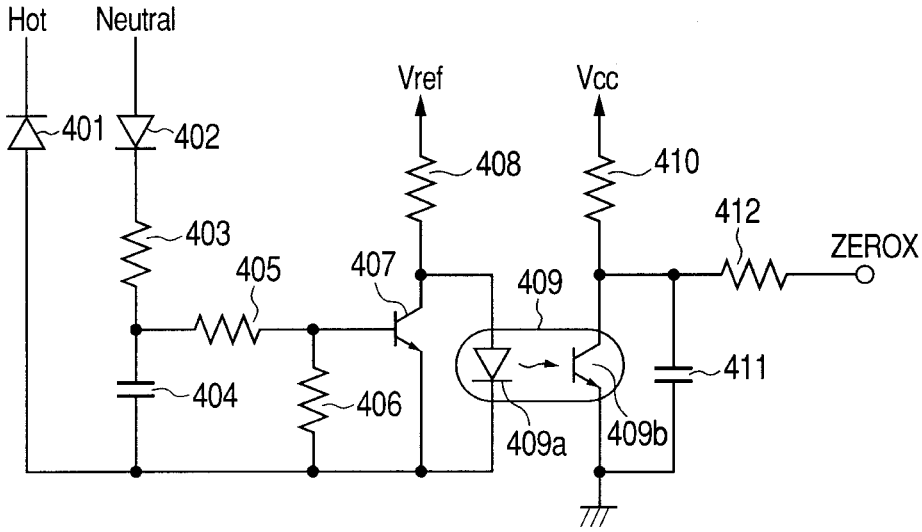
FIG. 4 is a configuration diagram of a zero-crossing detection circuit according to the first to third embodiments.

FIG. 4 illustrates a detailed circuit diagram of the zero-crossing detection circuit 310. The AC voltage from the AC power supply 301 is input to the zero-crossing detection circuit 310 of FIG. 4, and is half-wave-rectified by rectifiers 401 and 402. In this circuit, a neutral side is rectified. The half-wave-rectified AC voltage is input to a base of a transistor 407 via a resistor 403, a capacitor 404, and resistors 405 and 406. Vref depicts a voltage value supplied from the DC voltage source to the emitter terminal of the transistor, for the standard electric potential. Therefore, if a potential on the neutral side is higher than a potential on a hot side, the transistor 407 is turned on, while if the potential on the neutral side is lower than the potential on the hot side, the transistor 407 is turned off.

A photocoupler 409 is an element for securing the creeping distance between the primary and the secondary. Resistors 408 and 410 are resistors for limiting the current flowing in the photocoupler 409. The transistor 407 is turned on when the potential on the neutral side is higher than the potential on the hot side, and hence a light-emitting diode 409*a* of the photocoupler 409 is lighted off, a phototransistor 409*b* of the photocoupler 409 is turned off, and an output voltage of the photocoupler 409 becomes high. Meanwhile, the transistor 407 is turned off when the potential on the neutral side is lower than the potential on the hot side, and hence the light-emitting diode 409*a* of the photocoupler 409 is lighted on, the phototransistor 409*b* of the photocoupler 409 is turned on, and the output voltage of the photocoupler 409 becomes low. The CPU 309 is notified of an output from the photocoupler 409 as the zero-crossing (ZEROX) signal via a resistor 412.

The zero-crossing signal is a pulse signal having a signal frequency equal to the frequency of the AC power supply. The signal level of the zero-crossing signal changes depending upon the potential polarity of the AC power supply. The CPU 309 detects edges of the rising and falling of the zero-crossing signal, and turns on/off the triac 302 with the edges as triggers, to thereby supply the power to the heater 202.

(Current Detection Circuit)

Figure 5:
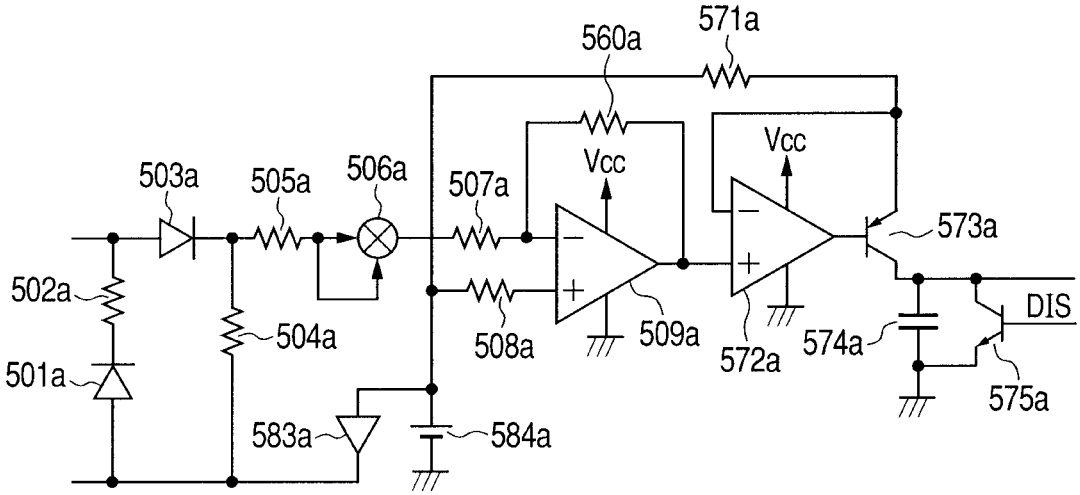
FIG. 5 is a configuration diagram of a current detection circuit according to the first to third embodiments.
Figure 6:
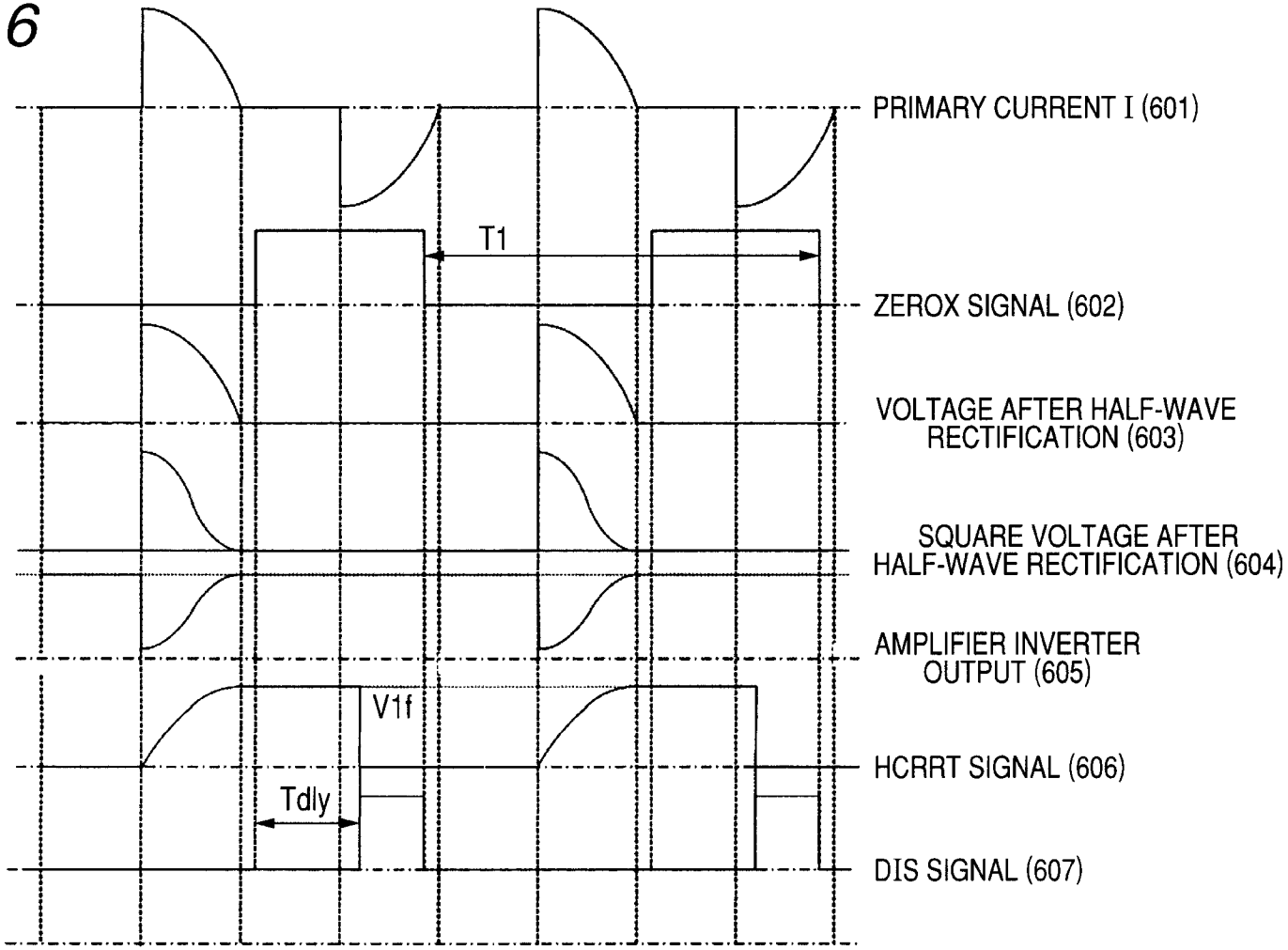
FIG. 6 is a wave form diagram of the current detection circuit according to the first embodiment.

FIG. 5 is a block diagram for illustrating a configuration of the current detection circuit 313 according to this embodiment. FIG. 6 is a wave form diagram for describing an operation of the current detection circuit 313. When a current I 601 having such a wave form illustrated in FIG. 6 is caused to flow in the heater 202, the current detection transformer 312 voltage-transforms a current wave form thereof on the secondary side. The voltage output from the current detection transformer 312 is rectified by diodes 501*a* and 503*a*. Resistors 502*a* and 504*a* are connected to this circuit as load resistors. FIG. 6 illustrates a wave form of a voltage 603 obtained by half-wave rectification carried out by the diode 503*a*. The voltage wave form is input to a multiplier 506*a* via a resistor 505*a*. As illustrated in FIG. 6, the multiplier 506*a* outputs a wave form of a square voltage 604. The wave form of the square voltage is input to a "–" terminal of an operational amplifier 509*a* via a resistor 507*a*. A reference voltage 584*a* is input to a "+" terminal of the operational amplifier 509*a* via a resistor 508*a*, and the output is inverted and amplified by a feedback resistor 560*a*. Note that, the operational amplifier 509*a* has power supplied from a single power supply.

FIG. 6 illustrates a wave form of an amplified inverted output 605 based on the reference voltage 584*a*. The output from the operational amplifier 509*a* is input to a "+" terminal of an operational amplifier 572*a*. The operational amplifier 572*a* controls a transistor 573*a* so that a current determined by a voltage difference between the reference voltage 584*a* and the voltage of the wave form input to the "+" terminal thereof and a resistor 571*a* is caused to flow in a capacitor 574*a*. In such a manner, the capacitor 574*a* is charged with the current determined by the voltage difference between the reference voltage 584*a* and the voltage of the wave form input to the "+" terminal of the operational amplifier 572*a* and the resistor 571*a*.

After the end of a segment for the half-wave rectification carried out by the diode 503*a*, there is no charging current to the capacitor 574*a*, and hence a voltage value thereof is peak-held. Then, as illustrated in FIG. 6, a DIS signal 607 (timing signal) is used to turn on a transistor 575*a* in a half-wave rectification period of the diode 501*a*. Accordingly, the charged voltage of the capacitor 574*a* is discharged. As illustrated in FIG. 6, the transistor 575*a* is turned on/off by the DIS signal 607 sent from the CPU 309, and the on/off control of the transistor 575*a* is performed based on the ZEROX signal 602. The DIS signal is turned on after a predetermined time Tdly has elapsed after the rising edge of the ZEROX signal, and is turned off at the same timing as the falling edge of the ZEROX signal or immediately before the falling edge.

This allows the CPU 309 to control a current detection operation performed by the current detection circuit 313 without interfering with the energization period of the heater 202, which is the half-wave rectification period of the diode 503*a*. That is, a peak-hold voltage V1*f* (corresponding to current value If) of the capacitor 574*a* illustrated in FIG. 6 is a value obtained by integrating on a half-wave basis the squared value of the wave form obtained by secondary voltage-transform by the current detection transformer 312. Accordingly, the voltage value peak-held by the capacitor 574*a* is sent from the current detection circuit 313 to the CPU 309 as the HCRRT signal.

(Phase Control and Wave Number Control)

(Advantages and Drawbacks of Phase Control)

Figure 7:
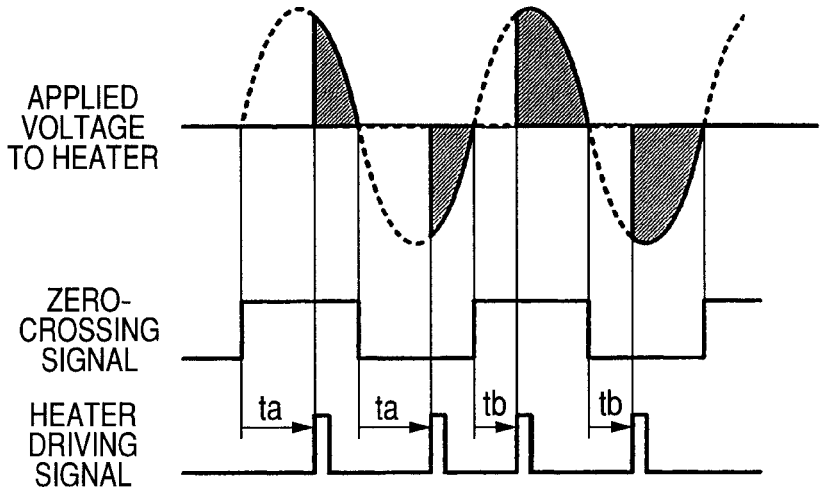
FIG. 7 is an explanatory diagram of phase control according to the first to third embodiments.

Next, the phase control and the wave number control that are the power control methods for the heater 202 are described. FIG. 7 illustrates an example of an applied voltage to the heater, the zero-crossing signal, and the heater driving signal in the case of the phase control. The zero-crossing signal switches a logic thereof at a point (zero-crossing point) at which the sign of the AC power supply is switched from positive to negative or from negative to positive. When the CPU 309 turns on the heater driving signal after a time "ta" has elapsed after the rising edge and the falling edge of the zero-crossing signal, the current is caused to flow in the heater 202 and the power is supplied in the shaded areas of FIG. 7. Note that, after the heater 202 is turned on, the energization of the heater 202 is turned off at the next zero-crossing point. Therefore, when the heater driving signal is again turned on after the time ta has elapsed after the edge of the zero-crossing signal, the same power is supplied to the heater 202 also in the next half-wave. Further, when the heater driving signal is turned on after a time "tb" different from the time ta has passed, the time for energizing the heater 202 changes. Therefore, the power supplied to the heater 202 may be changed.

As described above, the CPU 309 controls the power supplied to the heater 202 by changing the time elapsing from the edge of the zero-crossing signal until the heater driving signal is turned on in units of half-wave of the voltage applied to the heater 202. In the phase control, the energization to the heater 202 is turned on halfway through the half-wave of the AC power supply wave form as described in FIG. 7, and hence the current flowing in the heater 202 abruptly rises, causing a harmonic current to flow. The harmonic current increases as the rising amount of the current becomes larger. Therefore, the harmonic current becomes a maximum at a phase angle of 90°, that is, a supply power of 50%. Further, the rising edge of the current is generated on a half-wave basis, and hence a large amount of harmonic current is caused to flow, which necessitates compliance with the regulation of the harmonic current. Therefore, circuit parts, such as a filter, are often necessary. Meanwhile, a current smaller than one half-wave is caused to flow on a half-wave basis, and hence there is little influence on flicker due to a small change amount of the current and a short change period of the current.

(Advantages and Drawbacks of Wave Number Control)

Figure 8:
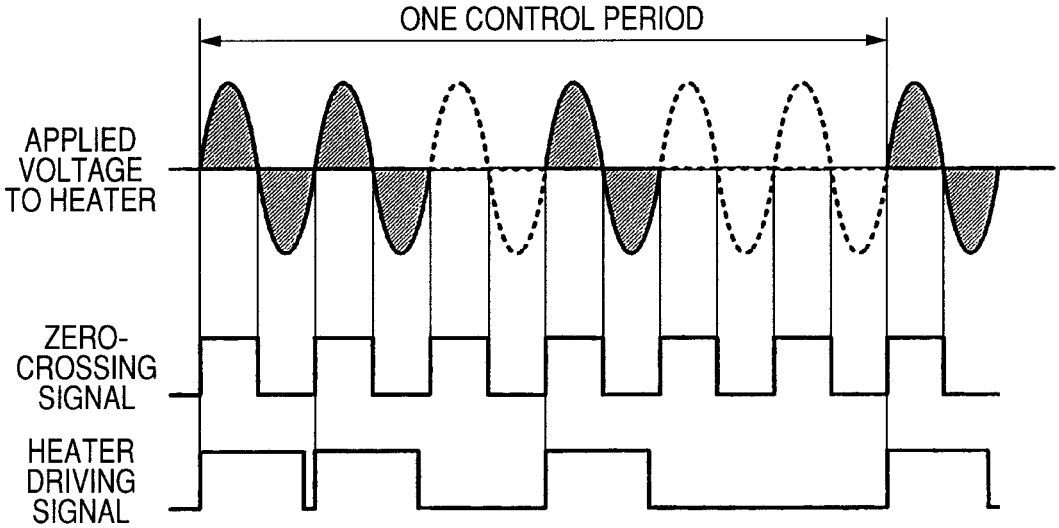
FIG. 8 is an explanatory diagram of wave number control according to the first to third embodiments.

FIG. 8 illustrates an example of the applied voltage to the heater, the zero-crossing signal, and the heater driving signal in the case of the wave number control. In the wave number control, the on/off control is performed in units of half-wave of the AC power supply. Therefore, for the on control, the heater driving signal is turned on along with the edge of the zero-crossing signal. For example, 12 half-waves are set as one period (one control period), and the number of half-waves is changed in one control period, thereby controlling the power supplied to the heater 202. In FIG. 8, of the 12 half-waves, 6 half-waves are turned on, and hence the power supplied to the heater 202 is 50%. Note that, it is assumed here that 2 consecutive half-waves are turned on in order to turn on the heater driving signal. In the wave number control, the heater 202 is always turned on/off at the zero-crossing point. Therefore, there is no such abrupt rising edge of the current as in the phase control, resulting in an extremely small amount of harmonic current. On the other hand, the current is caused to flow in units of half-wave, and hence there is much influence on flicker due to the large change amount of the current and the long change period of the current. Therefore, by devising the position (control pattern) of the half-wave to be turned on in one control period, the change period of the current is shortened, to thereby reduce the influence on the flicker to a minimum.

(Advantages and Drawbacks of Control Combining Phase Control and Wave Number Control)

In this embodiment, assuming that a plurality of AC half-waves (hereinafter, referred to merely as "half-waves") of the AC power supply are set as one control as in the wave number control, control is performed so that partial half-waves thereof are subjected to the phase control while the remaining half-waves are subjected to the wave number control. Further, a positive half-wave at which the power is supplied is defined as a positive energization cycle, a negative half-wave at which the power is supplied is defined as a negative energization cycle, and a half-wave at which the power is not supplied is defined as a non-energization cycle. In such a control method, in particular, the phase control is not performed on a half-wave basis, which allows reduction of the flowing harmonic current. Meanwhile, the phase control allows multistage control of the supply power even in short control periods, and therefore may shorten the control period in comparison with a normal wave number control, with the result that the change period of the current is shortened while the flicker becomes easy to reduce. However, the wave form obtained by voltage-transform by the current detection transformer 312 generates distortion due to the inherent characteristics of the element. In particular, in a case of detecting an effective current value, the effective value changes due to the distortion of the wave form, which lowers current detection precision. Note that, the amount of distortion generated in the current detection transformer 312 varies depending upon the amplitude, the phase angle, the frequency, and the like of a primary-side input wave form. In particular, if there is steep fluctuation in the load on the primary side, the amount of distortion generated in the current detection transformer 312 increases.

In the above-mentioned method, combining the phase control and the wave number control, the fluctuation in the load current is larger than the conventional phase control because the phase control and the wave number control are changed over in one control period, and hence it is difficult to detect a current with accuracy. Therefore, according to this embodiment, a desired precision may be realized in the above-mentioned method combining the phase control and the wave number control by devising a control wave form combining the phase control and the wave number control to cancel a positive error and a negative error that are generated by the distortion of the wave form due to the current detection transformer 312.

(Control Combining Phase Control and Wave Number Control According to this Embodiment)

Figure 9:
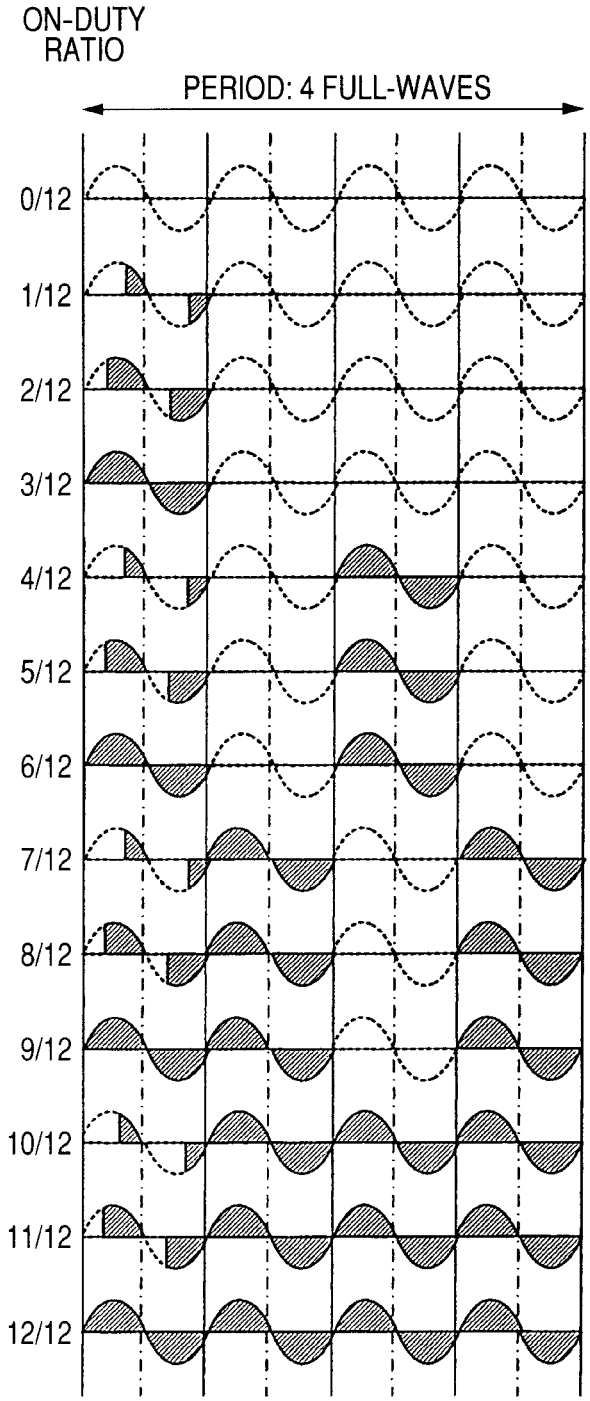
FIG. 9 is a diagram illustrating control patterns according to a comparative example for comparison with the first embodiment.
Figure 10:
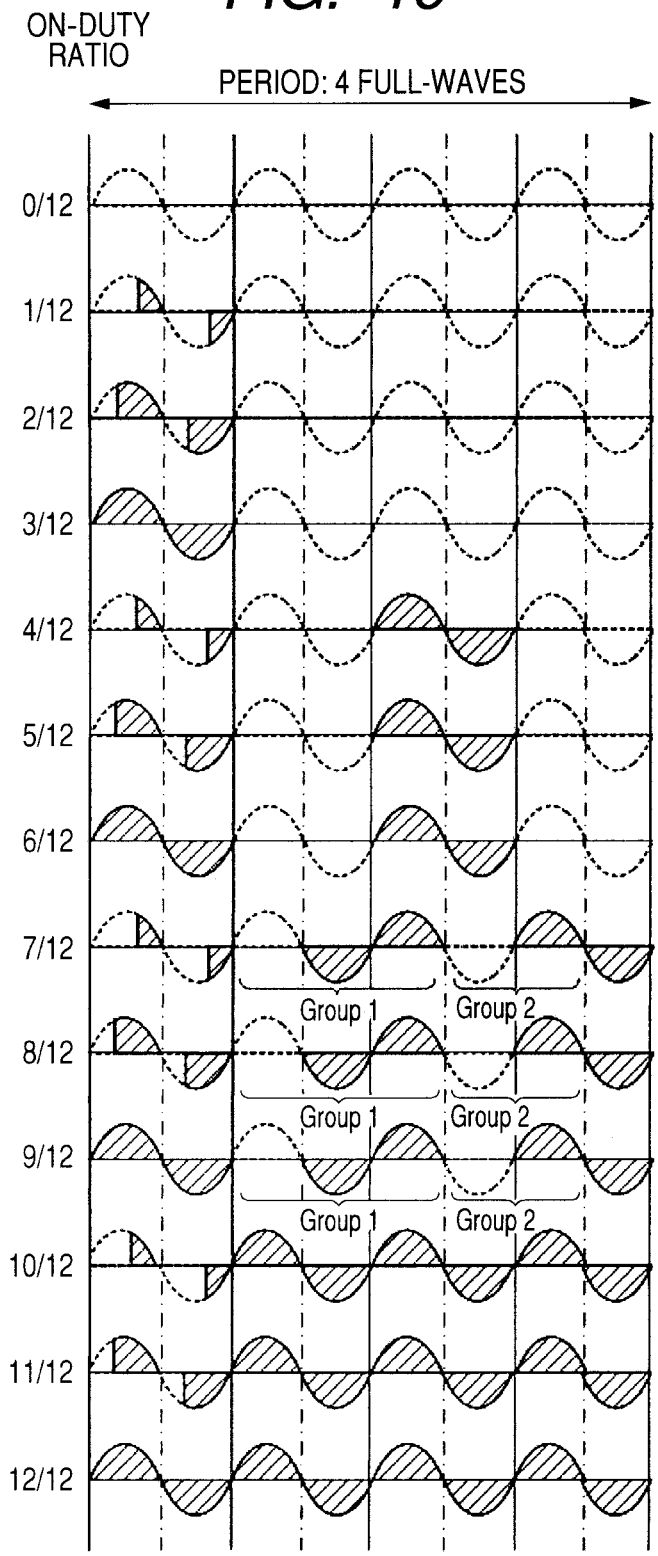
FIG. 10 is a diagram illustrating control patterns of heater power control according to the first and second embodiments.

FIGS. 9 and 10 illustrate pattern examples of heater power control of the method combining the phase control and the wave number control. FIG. 9 illustrates control pattern examples according to a comparative example for describing effects of the control patterns according to this embodiment. FIG. 10 illustrates control pattern examples of the heater power control according to this embodiment. In FIGS. 9 and 10, assuming that 4 full-waves (=8 half-waves) are set as one control period, 6 half-waves thereof are subjected to the wave number control, and 2 half-waves thereof are subjected to the phase control. The power supplied to the heater ranging from 0% to 100% is divided into twelve, for each of which the position (control pattern) for turning on the heater 202 is determined. For example, in FIG. 9, in a case of the power duty 1/12 (=8.3%), the phase control is performed so that the power duty of the first half-wave and the second half-wave becomes 33.3%. The wave number control portions corresponding to the remaining 6 half-waves are all turned off, thereby causing the power of approximately 8.3% to be supplied in one control period.

For example, in order to perform the phase control so that the power duty of the half-waves becomes 33.3%, by converting the power duty into a phase angle (α(°)) corresponding to the power ratio (dutyD(%)) of the power to be supplied, the CPU 309 sends the heater driving signal (on signal) to the transistor 307. For example, the CPU 309 includes such data as in Table 1 described below, and performs control based on the following control table.

TABLE 1

Conversion table between power ratio and phase angle

| Power ratio duty D (%) | Phase angle α (°) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

At the power duty 7/12 (=58.3%), the first half-wave and the second half-wave are turned on so that the power duties thereof each become 33.3%. Of the wave number control portions corresponding to the remaining 6 half-waves, the third half-wave, the fourth half-wave, the seventh half-wave, and the eighth half-wave are turned on, thereby causing the power of approximately 58.3% to be supplied in one control period. In such a manner, as the control patterns (wave form patterns of respective power ratios), as illustrated in FIGS. 9 and 10, 13 stages are set from the power duty 0/12 at which the supply power is 0% to the power duty 12/12 at which the supply power is 100%. Of the 13-stage control patterns of FIG. 10, the power duties 7/12 to 9/12 indicate an example of the current wave form proposed in this embodiment. In such a manner, by assuming that a predetermined number of half-waves continuing in the AC wave form are set as one control period, the current control part according to this embodiment sets the power ratio (power duty) corresponding to the sensed temperature in each control period. Further, the wave forms corresponding to the respective power ratios include a half-wave turned on halfway through one half-wave (half-wave for phase control) and a half-wave at which the entirety of one half-wave is turned on or off (half-wave for wave number control).

(Equivalent Circuit of Current Detection Transformer that Generates Distortion)

Figure 11:
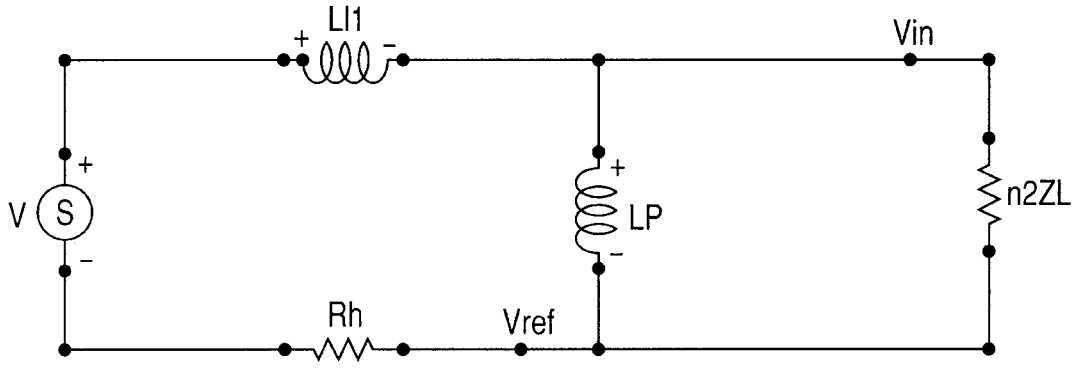
FIG. 11 is a diagram illustrating an equivalent circuit of a current detection transformer according to the first to third embodiments.

FIG. 11 illustrates an equivalent circuit diagram for describing a correction method for distortion generated by the current detection transformer 312. In the circuit diagram, influences of a primary inductance LP and a primary winding leakage inductance are taken into consideration with respect to an ideal transformer exhibiting no distortion. In a simulation carried out for describing this embodiment, influences of primary and secondary winding resistances, a stray capacitance, and a core loss are small, which are omitted from the equivalent circuit diagram. In the equivalent circuit diagram, V represents a power supply voltage (phase control wave form), Vin represents an input voltage of the current detection transformer 312, L11 represents the primary winding leakage inductance, LP represents the primary inductance, Rh represents a heat element, and n2ZL represents (secondary load resistance)×(squared value of a winding ratio of the current detection transformer 312).

(Results of Simulation Using Equivalent Circuit)

Figures 12A, 12B:
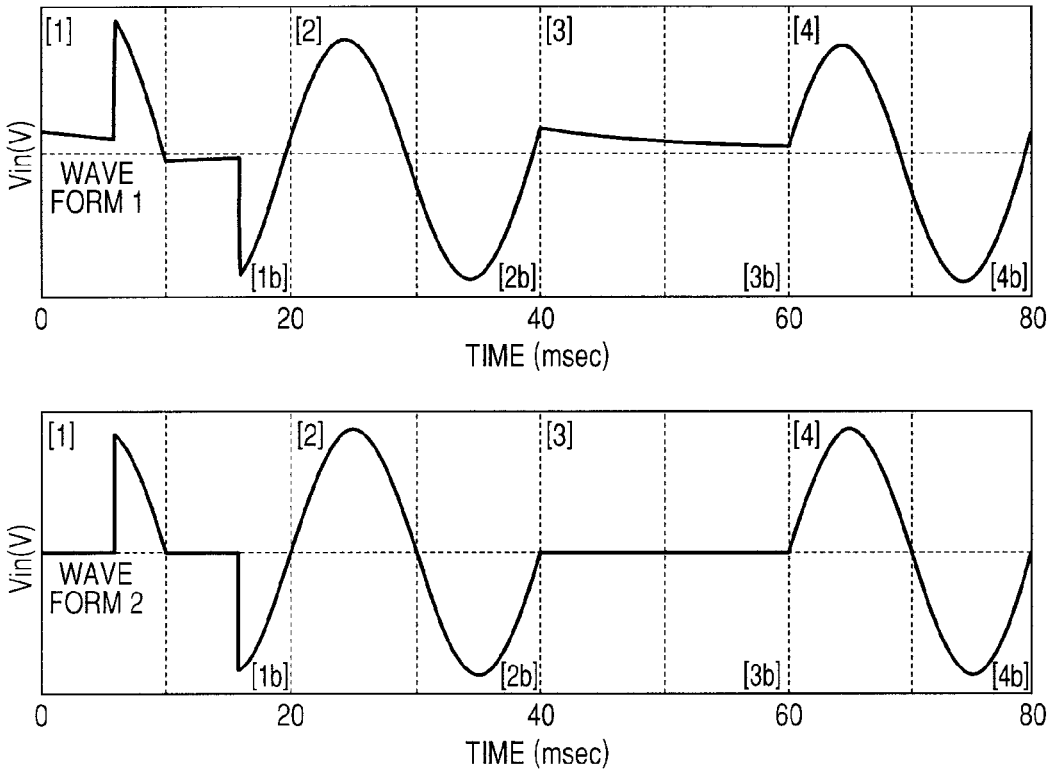
FIGS. 12A and 12B are diagrams illustrating and indicating simulation results according to the comparative example for comparison with the first embodiment.
Figures 13A, 13B:
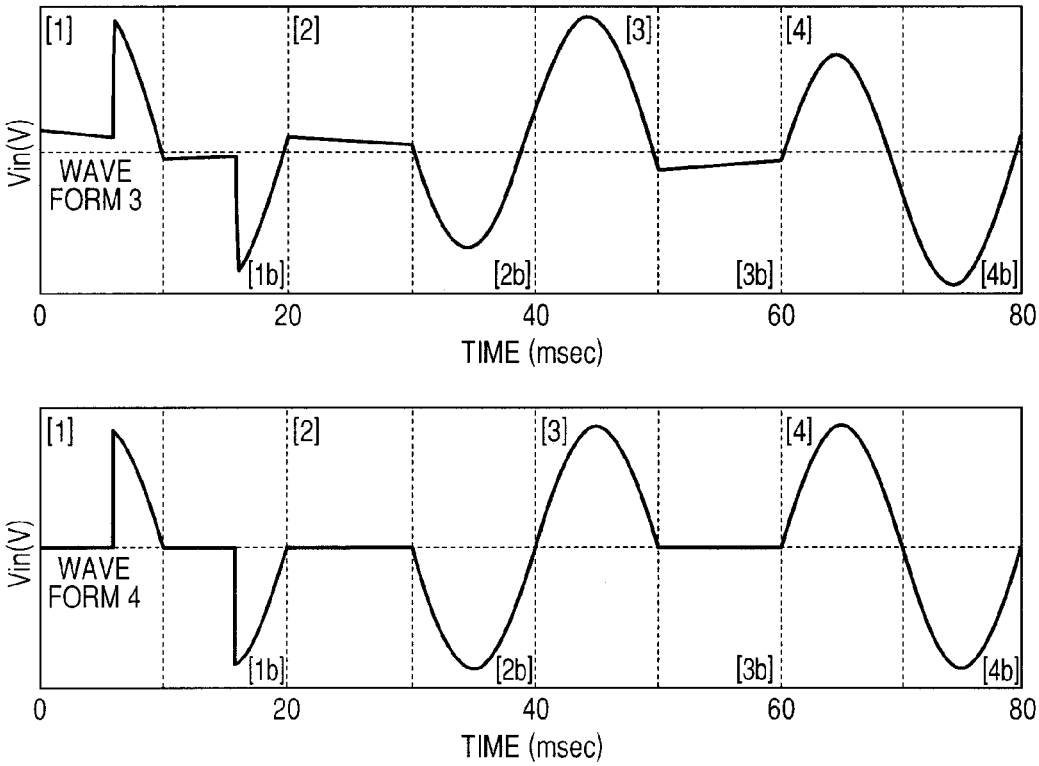
FIGS. 13A and 13B are diagrams illustrating and indicating simulation results of a heater current according to the first embodiment.

FIGS. 12A and 13A illustrate simulation wave forms used in the equivalent circuit diagram of FIG. 11. Here, the control patterns of FIGS. 9 and 10 are described by focusing attention on the wave form of the power duty 7/12 (=58.3%).

(Case of Control Pattern According to Comparative Example)

With reference to FIGS. 12A and 12B, the influence exerted upon the HCRRT signal 606 of FIG. 6 by the wave form distortion generated by the current detection transformer 312 illustrated as the comparative example, that is, the influence exerted upon the current detection is described. The HCRRT signal having no distortion caused by the current detection transformer 312 or no error in the current detection exhibits a value proportionate to one of the squared value of the effective current value on the primary side of the current detection transformer and the power supplied to the load (heater) on the primary side. However, when the load on the primary side of the current detection transformer fluctuates, as in a wave form 1 of FIG. 12A, distortion occurs in the voltage wave form output to the secondary side of the current detection transformer 312. The distortion of the voltage wave form lowers the detection precision of the current detection circuit 313. For comparison purposes, a wave form 2 indicates a voltage wave form generating no distortion. The voltage wave form is distorted as in the wave form 1 because of an inductance component of the current detection transformer 312. In particular, when a half-wave at which no current is caused to flow in the load (heater) (half-wave at which the entirety of one half-wave is turned off) exists in one control period, the load fluctuation when the current is caused to flow becomes large, and the voltage wave form is easily distorted due to the inductance component. The half-wave next to the half-wave at which no current is caused to flow in the load is distorted in a direction in which the voltage wave form becomes small. The half-wave subsequent thereto is distorted in a direction in which the voltage wave form becomes large. For example, as in the wave form 1 of FIG. 12A, a half-wave [3*b*] is a half-wave at which no current is caused to flow, and a voltage wave form [4] on the transformer secondary side of the subsequent half-wave has a wave form smaller than the voltage wave form of the current actually flowing in the load. Further, a voltage wave form [4*b*] on the transformer secondary side of the subsequent half-wave is a wave form larger than the voltage wave form of the current actually flowing in the load.

A table of FIG. 12B indicates output values of the HCRRT signal output by the current detection circuit 313 with regard to the wave form 1 and the wave form 2 of FIG. 12A. In FIG. 12B, output values (V) are shown as values normalized by assuming that a signal value of the wave form having no distortion in the case of a duty of 100% is 1 V. In this embodiment, as illustrated in FIG. 6, the current detection is performed only on the positive half-wave after the half-wave rectification as in the voltage 603. Therefore, the HCRRT signal corresponding to a half-wave [1], a half-wave [2], a half-wave [3], and the half-wave [4] as illustrated in FIG. 12A may be output. The outputs of the HCRRT signal corresponding to the half-wave [2] and the half-wave [4] of the wave form 1 indicated in FIG. 12B are found to exhibit output values lower than the wave form 2. In a case where the load on the primary side of the current detection transformer 312 increases as in the half-wave [2] and the half-wave [4], the outputs of the HCRRT signal decrease due to the negative wave form distortion.

Further, the outputs of the HCRRT signal corresponding to the half-wave [1] and the half-wave [3] of the wave form 1 are found to exhibit output values higher than the wave form 2. In a case where the load on the primary side of the current detection transformer 312 decreases as in the half-wave [1] and the half-wave [3], the outputs of the HCRRT signal increase due to the positive wave form distortion. If an average value of the output values of the HCRRT signal corresponding to the half-wave [1], the half-wave [2], the half-wave [3], and the half-wave [4] of the wave form 1 is calculated, an error of −21% occurs with respect to the outputs of the wave form 2 in which no distortion is generated by the current detection transformer 312. If the error of the HCRRT signal is converted into an effective current value, an error of approximately 11% occurs. The table of FIG. 12B indicates the average value (V) of the HCRRT signal in one control period, the error(%) thereof, and the error(%) of the effective current value thereof.

Accordingly, in the method combining the phase control and the wave number control, the fluctuation in load current (current flowing in the heater) is larger than the conventional phase control because the phase control and the wave number control are changed over in one control period, and hence it is difficult to detect a current with accuracy. This embodiment proposes the above-mentioned method combining the phase control and the wave number control for alleviating the influence of the error due to the distortion by devising the control wave form combining the phase control and the wave number control to cancel the positive error and the negative error that are generated by the distortion of the wave form due to the current detection transformer 312.

(Case of Control Pattern According to this Embodiment)

With reference to FIGS. 13A and 13B, the effect of the control pattern example illustrated in FIG. 10 proposed in this embodiment is described. A wave form 3 of FIG. 13A indicates a voltage wave form exhibiting distortion due to the current detection transformer 312 that has performed the simulation according to the equivalent circuit diagram of FIG. 11. For comparison purposes, a wave form 4 indicates a voltage wave form generating no distortion. A table of FIG. 13B indicates output values of the HCRRT signal output by the current detection circuit 313 with regard to the wave form 3 and the wave form 4 of FIG. 13A.

The description is provided by focusing attention on a half-wave [3] and a half-wave [4] of the wave form 3 illustrated in FIG. 13A. The half-wave [3] is a positive half-wave to be turned on subsequent to a negative half-wave [2*b*] that is turned on immediately after a half-wave [2] at which no current is caused to flow in the heater (positive half-wave at which the entirety of one half-wave is turned off). The half-wave [4] is a half-wave (positive half-wave to be turned on) at which a current is caused to flow in the heater immediately after a half-wave [3*b*] at which no current is caused to flow in the heater (negative half-wave at which the entirety of one half-wave is turned off). The half-wave [4] allows energization from the positive energization cycle, while the half-wave [3] allows energization from the half-wave [2*b*] of the negative energization cycle. The output of the HCRRT signal at the half-wave [4], which is immediately after the half-wave [3*b*] at which the entirety of one half-wave is turned off, is reduced compared to the voltage corresponding to the current actually flowing in the heater (voltage value at the half-wave [4] of the wave form 4). In contrast, the output of the HCRRT signal at the half-wave [3], which is two half-waves after the half-wave [2] at which the entirety of one half-wave is turned off, is increased compared to the voltage corresponding to the current actually flowing in the heater (voltage value at the half-wave [3] of the wave form 4).

If the average value of the output values of the HCRRT signal corresponding to a half-wave [1], the half-wave [2], the half-wave [3], and the half-wave [4] of the wave form 3 is calculated, an error of approximately −10% occurs with respect to the average value of the wave form 4 in which no distortion is generated by the current detection transformer 312. The error of the average value of the wave form 1 is approximately −21%, and hence the current detection precision may be greatly improved in the wave form 3 compared to the wave form 1. The average voltage of the output values of the HCRRT signal corresponding to the 4 half-waves exhibits a value effective for controlling the heater 202 because the average voltage is a value proportionate to one of the squared value of the effective current value on the primary side of the current detection transformer and the power supplied to the load on the primary side with regard to the 4 full-waves corresponding to one control period, according to this embodiment. The above-mentioned results of the current detection precision are obtained from the simulation by the equivalent circuit of FIG. 11. Further, the distortion amount is different between the wave form 1 and the wave form 3 depending upon the characteristics of the current detection transformer 312. However, as in the wave form 3, the influence of the distortion may be alleviated by generating the negative distortion generated by allowing energization from the positive energization cycle in one control period and the positive distortion generated by allowing energization from the negative energization cycle in the one control period.

As described above, the error of the detected current value may be alleviated by including a first group and a second group in the wave form of the power ratio of the power supplied to the heater. The first group includes the positive half-wave [2] at which the entirety of one half-wave is turned off, the negative half-wave [2*b*] at which at least a portion of a half-wave is turned on, and the positive half-wave [3] at which at least a portion of a half-wave is turned on, which are arranged in the stated order immediately one after another. The second group includes the negative half-wave [3*b*] at which the entirety of one half-wave is turned off and the positive half-wave [4] at which at least a portion of a half-wave is turned on, which are arranged in the stated order immediately one after another. In the wave forms of FIG. 10, the wave forms including the first group and the second group as described above are set for the power ratios 7/12, 8/12, and 9/12.

Further, the following first group and second group may be included in the wave form. The first group includes the negative half-wave at which the entirety of one half-wave is turned off, the positive half-wave at which at least a part of a half-wave is turned on, and the negative half-wave at which at least a part of a half-wave is turned on, which are arranged in the stated order immediately one after another. The second group includes the positive half-wave at which the entirety of one half-wave is turned off and the negative half-wave at which at least a part of a half-wave is turned on, which are arranged in the stated order immediately one after another.

Here, the simulation wave forms of FIGS. 12A and 13A indicate the simulation results produced in a case of repeatedly outputting the wave form of the power duty 7/12 (=58.3%). The current detection results are subject to the influence of the current wave form in the entirety of one control period. Therefore, if there is no fluctuation in the power duty to be output, such a wave form as described with reference to FIG. 13A is output over two control periods. Then, by calculating the average value of the HCRRT signal including the wave form generating the positive distortion as in the half-wave [3] and the wave form generating the negative distortion as in the half-wave [4], the influence of the distortion may be alleviated in the same manner as the wave form of FIG. 13A.

In the control pattern examples illustrated in FIG. 10 used in this embodiment, the current wave form proposed in this embodiment is used for the power duties 7/12 to 9/12. The control pattern proposed in this embodiment is not used for the power duties 0/12 to 6/12 and the power duties 10/12 to 12/12.

In this embodiment, in the same manner as in Japanese Patent Application Laid-Open No. 2004-226557, the power duty (power ratio) corresponding to the sensed temperature in the fixing part is set so as to be equal to or less than Dlimit expressed by the following Equation (1).

$$D\text{limit}=(I\text{limit}/I1)2\times D1 \qquad \text{Equation (1)}$$

where D1 represents a predetermined fixed duty ratio at the time of starting supplying power to the heater, I1 represents a current value detected by a current detection part when the supplying of power to the heater is started at the fixed duty ratio (D1), and Ilimit represents a predetermined allowable current value that may be supplied to the heater and is the value of a current obtained by subtracting the current supplied to the loads other than the heater within the image forming apparatus from the rated current of the commercial AC power supply. In this embodiment, Ilimit depicts a value equivalent to the square value of the effective current value. Also, Ifk, Ik and Ipfc mentioned later respectively depict the square values of the effective current value.

In this embodiment, in consideration of an anticipated AC input voltage range, the resistance value of the heater 202, and the like, even if the power is supplied to the heater with the power duties 0/12 to 6/12, the current caused to flow in the heater is equal to or less than the upper limit current value Ilimit. This eliminates the need to detect a current with high precision within the range of the power duties 0/12 to 6/12.

Further, in the wave forms of the power duties 10/12 to 12/12, there is little influence of the distortion due to the current detection transformer 312 because the heater 202 is almost always in an on state with the load fluctuation on the primary side being small. Within the range of the power duties 10/12 to 12/12, even without using the control pattern proposed in this embodiment, necessary detection precision may be obtained. In such a manner, the control pattern proposed in this embodiment (wave form including the first group and the second group) is used for predetermined power duties that necessitate the control. Therefore, according to this embodiment, as in the wave forms of FIG. 10, the wave form including the first group and the second group is set only for the power ratios 7/12, 8/12, and 9/12. However, the wave form including the first group and the second group may be set for the wave forms of the other power ratios.

The maximum power duty necessary for the current detection and the necessary precision vary depending upon the image forming apparatus. The above-mentioned control indicates an example of the usage of the control pattern proposed in this embodiment.

As described above, the wave form of at least one power ratio of a plurality of power ratios includes: the first group of the half-wave at which the entirety of one half-wave is turned off, the negative half-wave at which at least a part of a half-wave is turned on, and the positive half-wave at which at least a part of a half-wave is turned on, which are arranged in the stated order immediately one after another; and the second group of the half-wave at which the entirety of one half-wave is turned off and the positive half-wave at which at least a part of a half-wave is turned on, which are arranged in the stated order immediately one after another. Alternatively, the wave form of at least one power ratio of the plurality of power ratios may include: the first group of the half-wave at which the entirety of one half-wave is turned off, the positive half-wave at which at least a part of a half-wave is turned on, and the negative half-wave at which at least a part of a half-wave is turned on, which are arranged in the stated order immediately one after another; and the second group of the half-wave at which the entirety of one half-wave is turned off and the negative half-wave at which at least a part of a half-wave is turned on, which are arranged in the stated order immediately one after another.

(Temperature Control of Heater According to this Embodiment)

Figure 14:
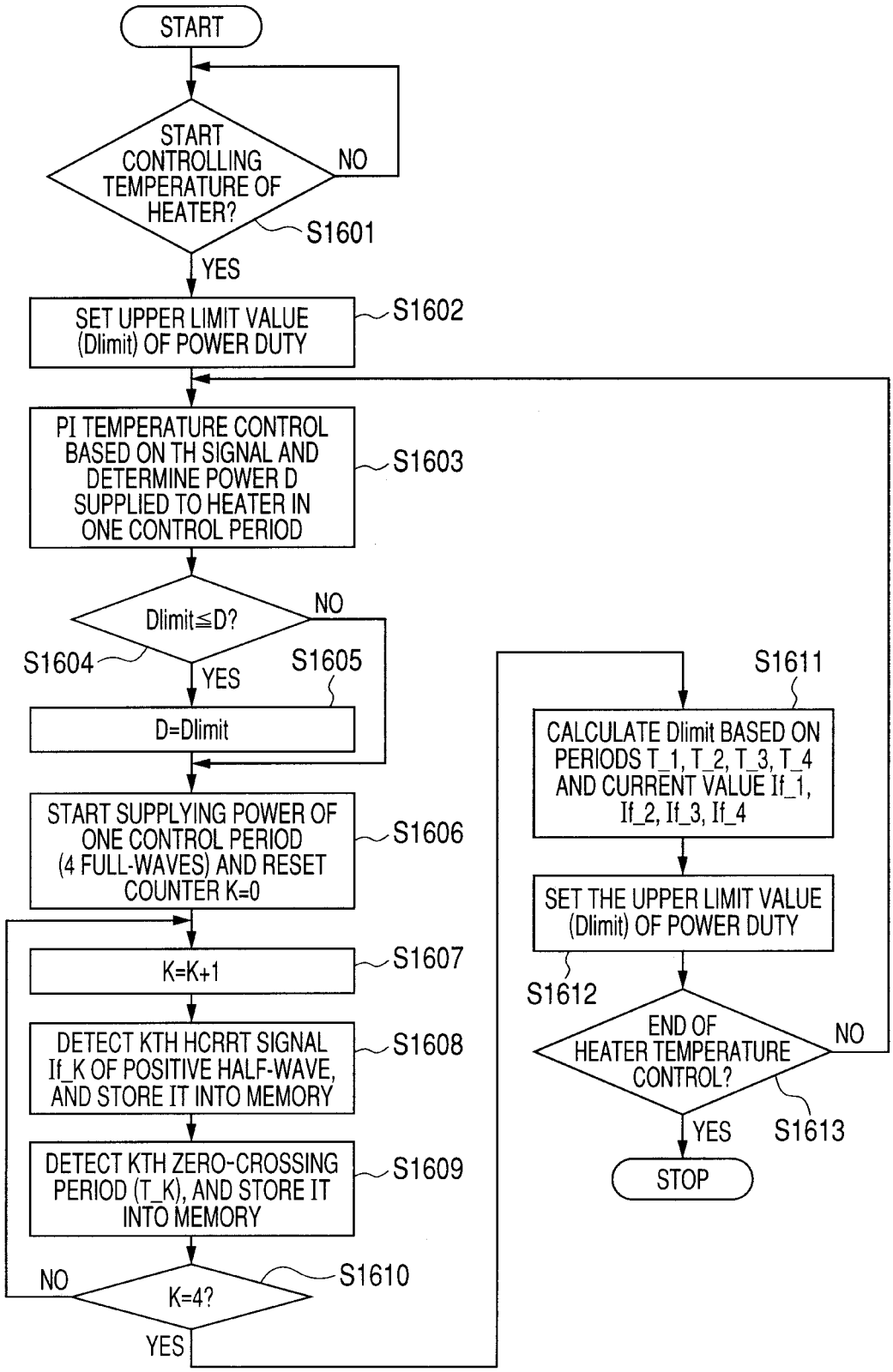
FIG. 14 is a flowchart for illustrating temperature control according to the first embodiment.

Next, a control sequence of the fixing apparatus 115 according to this embodiment is described. FIG. 14 is a flowchart for describing the control sequence of the fixing apparatus 115 performed by the CPU 309 according to this embodiment.

In Step 1601 (hereinafter, referred to as "S1601"), the CPU 309 determines whether or not a request for power supply start with respect to the heater 202 (start of temperature control of the heater) has been issued. If the CPU 309 determines that the request has been issued, the procedure advances to S1602.

In S1602, the CPU 309 initially sets a maximum value (upper limit value) Dlimit of the power duty in consideration of the anticipated AC input voltage range, the resistance value of the heater 202, and the like. Further, an upper limit value Ilimit of the current that may be supplied to the heater 202 is preset in the CPU 309.

In S1603, in order to perform the temperature control of the heater 202, the CPU 309 determines the power (power duty (%)) D supplied to the heater 202. The CPU 309 determines the power duty (power ratio) D supplied to the heater 202 according to, for example, proportional plus integral control (PI control) based on information from the TH signal so that the heater 202 reaches a predetermined set temperature. Note that, the predetermined temperature is assumed to be set in the CPU 309.

In S1604, the CPU 309 determines whether or not the power duty D calculated in S1603 is equal to or higher than the upper limit value Dlimit. If the CPU 309 determines that the power duty D is equal to or higher than the upper limit value Dlimit, the procedure advances to S1605, in which the CPU 309 sets D=Dlimit. That is, the CPU 309 performs the temperature control of the heater 202 with the power duty D equal to or less than the upper limit value Dlimit. If the CPU 309 determines in S1604 that the power duty is less than the upper limit value Dlimit, the procedure advances to the processing of S1606.

In S1606, the CPU 309 starts supplying power of one control period (4 full-waves) to the heater 202 based on the control pattern of FIG. 10 in order to subject the heater 202 to the temperature control with the power corresponding to the power duty D. At this time, the CPU 309 resets a counter K (K=0).

In S1607, the CPU 309 increments the counter K by one each time a half-wave of the positive energization cycle is output.

In S1608, the CPU 309 stores an output If_K of the detected Kth HCRRT signal corresponding to the positive half-wave into a memory within the CPU 309. Based on the calculated power duty D and the control pattern of FIG. 10, the CPU 309 acquires a voltage V1*f*_K (corresponding to current value If_K) by the HCRRT signal sent from the current detection circuit 313 in a state in which the Kth positive half-wave allows energization. The voltage V1*f*_K corresponds to the voltage V1*f*_K peak-held by the capacitor 574*a* as described above. That is, the voltage V1*f*_K is a peak-hold value of the HCRRT signal 606 illustrated in FIG. 6. In this embodiment, with the ZEROX signal as a trigger, the CPU 309 acquires the voltage V1*f*_K within the period Tdly from the rising edge of the ZEROX signal until the DIS signal is sent. The period Tdly is set as a time enough for the CPU 309 to detect the peak-hold value V1*f*_K.

In S1609, the CPU 309 detects a Kth zero-crossing period T_K (see zero-crossing signal 602 of FIG. 6). The CPU 309 may calculate a frequency (hereinafter, referred to as "commercial frequency") F_K of the power supply voltage by detecting a time interval T_K from the rising edge of the ZEROX signal 602 until the falling edge. The CPU 309 stores the detected time interval T_K into the memory within the CPU 309. However, if the above-mentioned processing is difficult in terms of sequence, T_1 to T_3 may be detected to set T_4=T_3 without detecting T_4.

In S1610, the CPU 309 repeats S1607 to S1609 until the current detection results for one control period (4 full-waves) (K=1 to 4) are obtained.

In S1611, the CPU 309 calculates the upper limit value Dlimit of the power duty based on the current values If_1 to If_4 for the 4 full-waves and the zero-crossing periods T_1 to T_4 which are stored in the memory within the CPU 309. Here, the value If_K notified by the HCRRT signal 606 is an integral value corresponding to a half-wave of the commercial frequency of the squared wave form as described above (see FIG. 6). With respect to the current value If_K at the frequency F_K Hz, the commercial frequency is set as a specific frequency, for example, 50 Hz is set as a reference frequency. The converted value of the current value If_K in terms of 50 Hz, which is assumed as I_K, is expressed as follows.

$$I_K = \mathrm{If}_K \times (F_K)/50$$

An updated value Dlimit of the upper limit power duty that allows energization is calculated from the current value I_K, the power duty D, and the upper limit current value Ilimit set in the CPU 309. The upper limit current value Ilimit may be set as, for example, the allowable current value (here, set as the converted value in terms of the frequency of 50 Hz) that may be supplied to the heater 202 which is obtained by subtracting the current supplied to the parts other than the heater 202 from the rated current of the connected commercial power supply, or the maximum current value necessary for the control. In this embodiment, the upper limit of the average value for one control period corresponding to the 8 half-waves is set as the upper limit current value Ilimit.

$$D\mathrm{limit} = 4 \times I\mathrm{limit}/(I_1 + I_2 + I_3 + I_4) \times D$$

In S1612, the CPU 309 calculates the power duty of the power supplied to the heater 202 by repeatedly performing the above-mentioned processing for each control period corresponding to the 4 full-waves of the commercial power supply until the temperature control of the heater 202 ends.

In this embodiment, the upper limit value Dlimit of the power duty is calculated by using the average value of current values I_1 to I_4 corresponding to the 4 full-waves.

In the case of the power duties D of 7/12 to 9/12, the current detection results of the current values I_1 to I_4 corresponding to the 4 full-waves include a current detection result of I_3 (corresponding to the half-wave [3] of FIG. 13A) exhibiting a positive error and a current detection result of I_4 (corresponding to the half-wave [4] of FIG. 13A) exhibiting a negative error. By calculating the average value of the current values I_1 to I_4 corresponding to the 4 full-waves, the positive error and the negative error cancel each other. Accordingly, the current detection precision may be enhanced compared to the wave form according to the comparative example as illustrated in FIG. 9.

In this embodiment, as exemplified by the control patterns of the power duties 7/12 to 9/12 of FIG. 10, the control pattern that generates a positive error and a negative error is output, and the current is detected in such manner that the current detection result exhibiting the positive error and the current detection result exhibiting the negative error cancel each other. This embodiment is characterized by thus alleviating the influence of the distortion due to the current detection transformer 312 and controlling the power supply to the heater 202 with high precision. In this embodiment, the CPU 309 is used to perform the control by using the average value of the current values I_1 to I_4 corresponding to the 4 full-waves, but the control may be performed by using, for example, the average value of the current value I_3 at the third full-wave and the current value I_4 at the fourth full-wave. Alternatively, the average value may be calculated by weighting the detection results of the current values I_1 to I_4 corresponding to the 4 full-waves.

Further, in this embodiment, the average value of the current values I_1 to I_4 corresponding to the 4 full-waves are calculated by an internal processing of the CPU 309. However, the present invention is not limited thereto. For example, the influence of the distortion due to the current detection transformer 312 may be alleviated similarly in a case where, for example, an integrating circuit outputs the integral value or the average value of the amplified inverted outputs 605 of FIG. 6 for one period or multiple periods. The method of using the integrating circuit is described in a fourth embodiment.

As a method of correcting the influence of the distortion due to the current detection transformer 312, there is a method of correcting the influence by an internal calculation of the CPU 309 based on a history of the phase angle, the frequency, the current value, and the load fluctuation. However, with the method of correcting the influence by the internal calculation of the CPU 309, the influence of the distortion due to the current detection transformer 312 is hard to alleviate in the case of using the above-mentioned integrating circuit. By the control according to this embodiment, the influence of the distortion due to the current detection transformer 312 is alleviated by devising the wave form of the control pattern. Therefore, this embodiment is also effective for a case of causing the average value of the outputs from the current detection circuit 313 to be output by an analog circuit.

Further, in this embodiment, the current detection circuit 313 performs the current detection only of the positive half-wave subjected to the half-wave rectification, but may perform the current detection only of the negative half-wave including the half-wave [2*b*] and the negative half-wave [4*b*] subsequent to the half-wave [4]. In the case of thus performing the current detection by using the negative half-wave, the wave form of the power ratio may include the first group of the negative half-wave at which the entirety of one half-wave is turned off, the positive half-wave at which at least a part of a half-wave is turned on, and the negative half-wave at which at least a part of a half-wave is turned on, which are arranged in the stated order immediately one after another; and the second group of the positive half-wave at which the entirety of one half-wave is turned off and the negative half-wave at which at least a part of a half-wave is turned on, which are arranged in the stated order immediately one after another.

According to this embodiment, the precision in the current detection may be improved in the case of controlling the supply power by combining the phase control and the wave number control. Further, even in a case of using a low cost current detection transformer exhibiting a large distortion amount, desired precision in the current detection may be obtained. In addition, in a case of using a current detection transformer exhibiting a small distortion amount, the current detection may be performed with higher precision.

Second Embodiment

In a second embodiment of the present invention, description of the structure, the configuration, and the control that are common with the first embodiment is omitted. The second embodiment is described by using the same reference symbols for the same components as those of the first embodiment.

(Control of Power Supplied to Ceramic Heater)

Figure 15:
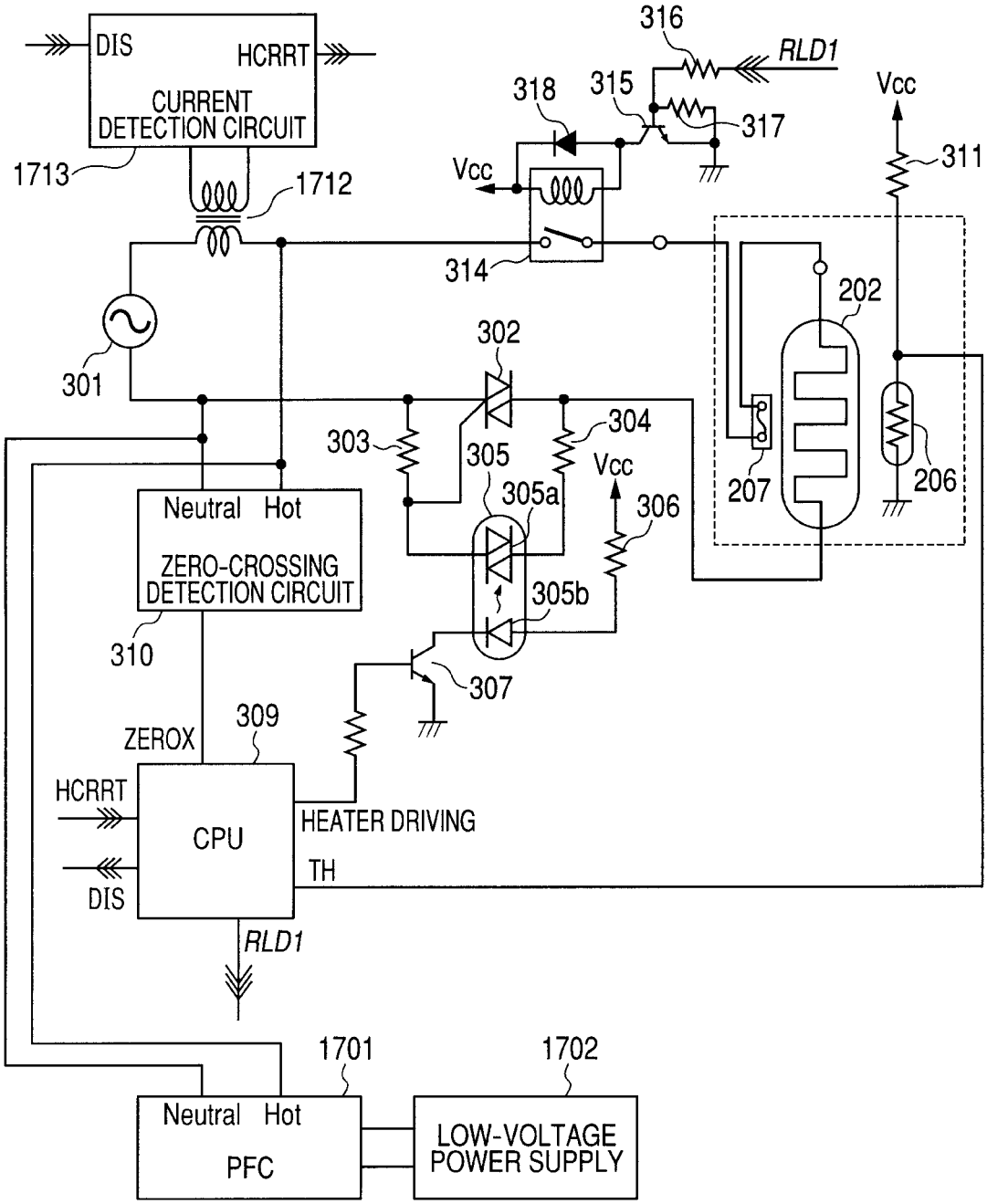
FIG. 15 is a configuration diagram of a heater driving circuit of the fixing apparatus according to the second embodiment.

FIG. 15 illustrates the driving circuit, the control circuit, and a power supply circuit for supplying power to the image forming apparatus, of the heater 202 according to this embodiment. In this embodiment, a current detection transformer 1712 is located in such a position as to detect a current that combines a heater current Ih flowing in the heater 202 and a PFC current Ipfc flowing in a power factor circuit (hereinafter, referred to merely as "PFC") 1701 of a low-voltage power supply (power supply circuit). That is, the image forming apparatus includes the power supply circuit connected to a line branched halfway through a power supply path from the commercial AC power supply to the heater, and the current detection part detects a current flowing in the power supply path on a commercial AC power supply side of a branch position between the heater and the power supply circuit. The low-voltage power supply (power supply circuit) is a circuit including an AC/DC converter.

That is, a current detection circuit 1713 detects a current that combines the heater current Ih and the PFC current Ipfc. In this embodiment, as in the control pattern examples of the power duties 7/12 to 9/12 of FIG. 10, the control pattern that generates a positive error and a negative error is output. In this embodiment, the current detection result exhibiting the positive error and the current detection result exhibiting the negative error cancel each other, to thereby alleviate the influence of the distortion due to the current detection transformer 1712. Then, the current that combines the current Ih supplied to the heater 202 and the current Ipfc supplied to the PFC 1701 is detected with high precision.

(Results of Simulation Using Equivalent Circuit)

Figures 16A, 16B:
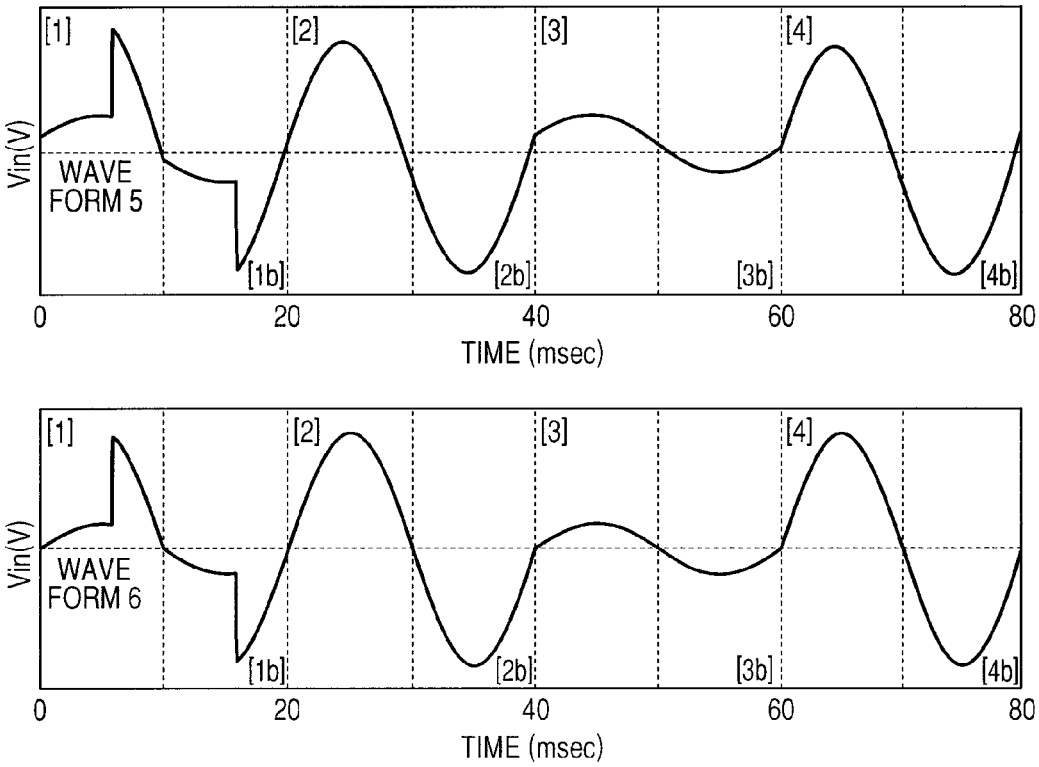
FIGS. 16A and 16B are diagrams illustrating and indicating simulation results according to a comparative example for comparison with the second embodiment.
Figures 17A, 17B:
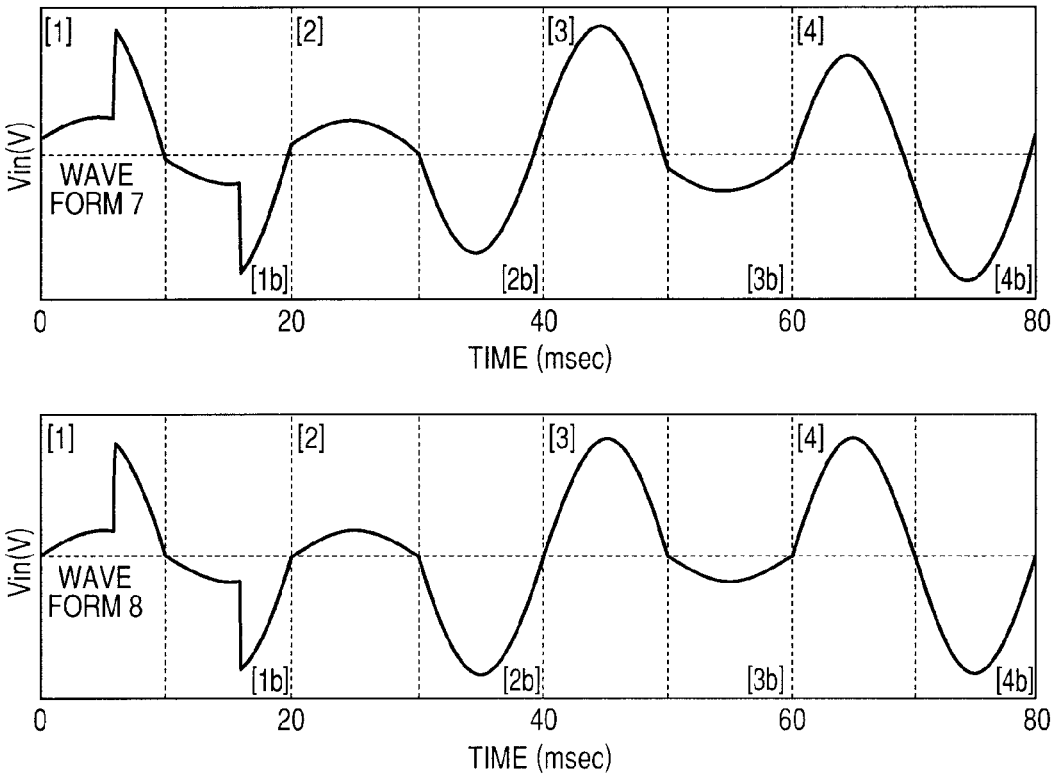
FIGS. 17A and 17B are diagrams illustrating and indicating simulation results of the heater current according to the second embodiment.

FIGS. 16A and 17A illustrate simulation wave forms used in the equivalent circuit diagram of FIG. 11. Here, the control patterns of FIGS. 9 and 10 by focusing attention on the wave form of the power duty 7/12 (=58.3%) is described. A simulation is performed by assuming that the current Ipfc flowing in the PFC 1701 is a sign wave having a power factor of 100%.

(Case of Control Pattern According to Comparative Example)

With reference to FIGS. 16A and 16B, an influence exerted upon the HCRRT signal by the wave form distortion generated by the current detection transformer 1712 of the control pattern illustrated as the comparative example is described.

The HCRRT signal having no distortion caused by the current detection transformer 1712 or no error in the current detection exhibits a value proportionate to one of the squared value of the effective current value on the primary side of the current detection transformer and the power supplied to the load on the primary side. However, when the load on the primary side of the current detection transformer fluctuates, as in a wave form 5 of FIG. 16A, distortion occurs in the voltage wave form output to the secondary side of the current detection transformer 1712. The distortion of the voltage wave form lowers the detection precision of the current detection circuit 1713. For comparison purposes, a wave form 6 indicates a voltage wave form generating no distortion.

A table of FIG. 16B indicates output values of the HCRRT signal output by the current detection circuit 1713 with regard to the wave form 5 and the wave form 6 of FIG. 16A. In this embodiment, as illustrated in FIG. 6, the current detection is performed only on the positive half-wave after the half-wave rectification. Therefore, the HCRRT signal corresponding to half-waves [1] to [4] as illustrated in FIG. 16A may be output. The outputs of the HCRRT signal corresponding to the half-wave [2] and the half-wave [4] of the wave form 5 indicated in FIG. 16B are found to exhibit output values lower than the wave form 6. In a case where the load on the primary side of the current detection transformer 1712 increases as in the half-wave [2] and the half-wave [4], the outputs of the HCRRT signal decrease due to the negative wave form distortion. Further, the outputs of the HCRRT signal corresponding to the half-wave [1] and the half-wave [3] of the wave form 5 are found to exhibit output values higher than the wave form 6. In a case where the load on the primary side of the current detection transformer 1712 decreases as in the half-wave [1] and the half-wave [3], the outputs of the HCRRT signal increase due to the positive wave form distortion. If an average value of the output values of the HCRRT signal corresponding to the half-waves [1] to [4] of the wave form 5 is calculated, an error of approximately −13.4% occurs with respect to the outputs of the wave form 6 in which no distortion is generated by the current detection transformer 1712. Accordingly, in the method combining the phase control and the wave number control, the fluctuation in load current is larger than the conventional phase control because the phase control and the wave number control are changed over in one control period, and hence it is difficult to detect a current with accuracy.

(Case of Control Pattern According to this Embodiment)

In this embodiment, the fact that the method for alleviating the current detection error described in the first embodiment is also effective for detecting the current that combines the heater current Ih and the PFC current Ipfc is described. With reference to FIGS. 17A and 17B, an effect of the control pattern example illustrated in FIG. 10 proposed in this embodiment is described. A wave form 7 of FIG. 17A indicates a voltage wave form exhibiting distortion due to the current detection transformer 1712 that has performed the simulation according to the equivalent circuit diagram of FIG. 11. For comparison purposes, a wave form 8 indicates a voltage wave form generating no distortion. In the same manner as the first embodiment, the half-wave [3] is a positive half-wave to be turned on subsequent to a negative half-wave [2*b*] that is turned on immediately after a half-wave [2] at which no current is caused to flow in the heater (positive half-wave at which the entirety of one half-wave is turned off). The half-wave [4] is a half-wave (positive half-wave to be turned on) at which a current is caused to flow in the heater immediately after a half-wave [3*b*] at which no current is caused to flow in the heater (negative half-wave at which the entirety of one half-wave is turned off).

A table of FIG. 17B indicates output values of the HCRRT signal output by the current detection circuit 1713 with regard to the wave form 7 and the wave form 8 of FIG. 17A. The description is provided by focusing attention on a half-wave [3] and a half-wave [4] of the wave form 7 illustrated in FIG. 17A. The half-wave [4] allows energization from the positive energization cycle, while the half-wave [3] allows energization to be started from a half-wave [2*b*] of the negative energization cycle. If the load on the primary side of the current detection transformer 1712 increases as in the half-wave [4], the output of the HCRRT signal decreases due to the distortion of the wave form. If the load on the primary side of the current detection transformer 1712 increases at the negative energization cycle as in the half-wave [2*b*], the distortion of the positive wave form is generated. The half-wave [3] is subject to the influence of the distortion of the positive wave form generated at the half-wave [2*b*], and hence the output of the HCRRT signal corresponding to the half-wave [3] increases.

If the average value of the output values of the HCRRT signal corresponding to the half-waves [1] to [4] of the wave form 7 is calculated, an error of approximately −6.5% occurs with respect to the average value of the wave form 8 in which no distortion is generated by the current detection transformer 1712. The error of the average value of the wave form 5 is approximately −13.4%, and hence the current detection precision may be greatly improved in the wave form 7 compared to the wave form 5. The average voltage of the output values of the HCRRT signal corresponding to the 4 half-waves exhibits a value proportionate to one of the squared value of the effective current value on the primary side of the current detection transformer and the power supplied to the load on the primary side with regard to the 4 full-waves corresponding to one control period according to this embodiment. The above-mentioned results of the current detection precision are obtained from the simulation by the equivalent circuit of FIG. 11. However, as in the wave form 7, the influence of the distortion by the current detection transformer 1712 may be alleviated by generating the negative distortion generated by allowing energization from the positive energization cycle in one control period and the positive distortion generated by allowing energization from the negative energization cycle in one control period. Even in such a case of detecting the current flowing in the power supply path on the commercial AC power supply side of the branch position between the heater and the power supply circuit, the precision in the current detection may be improved by setting the wave form of the power ratio set according to the sensed temperature of the temperature sensing element in the same manner as the wave form according to the first embodiment.

(Temperature Control of Heater According to this Embodiment)

Figure 18:
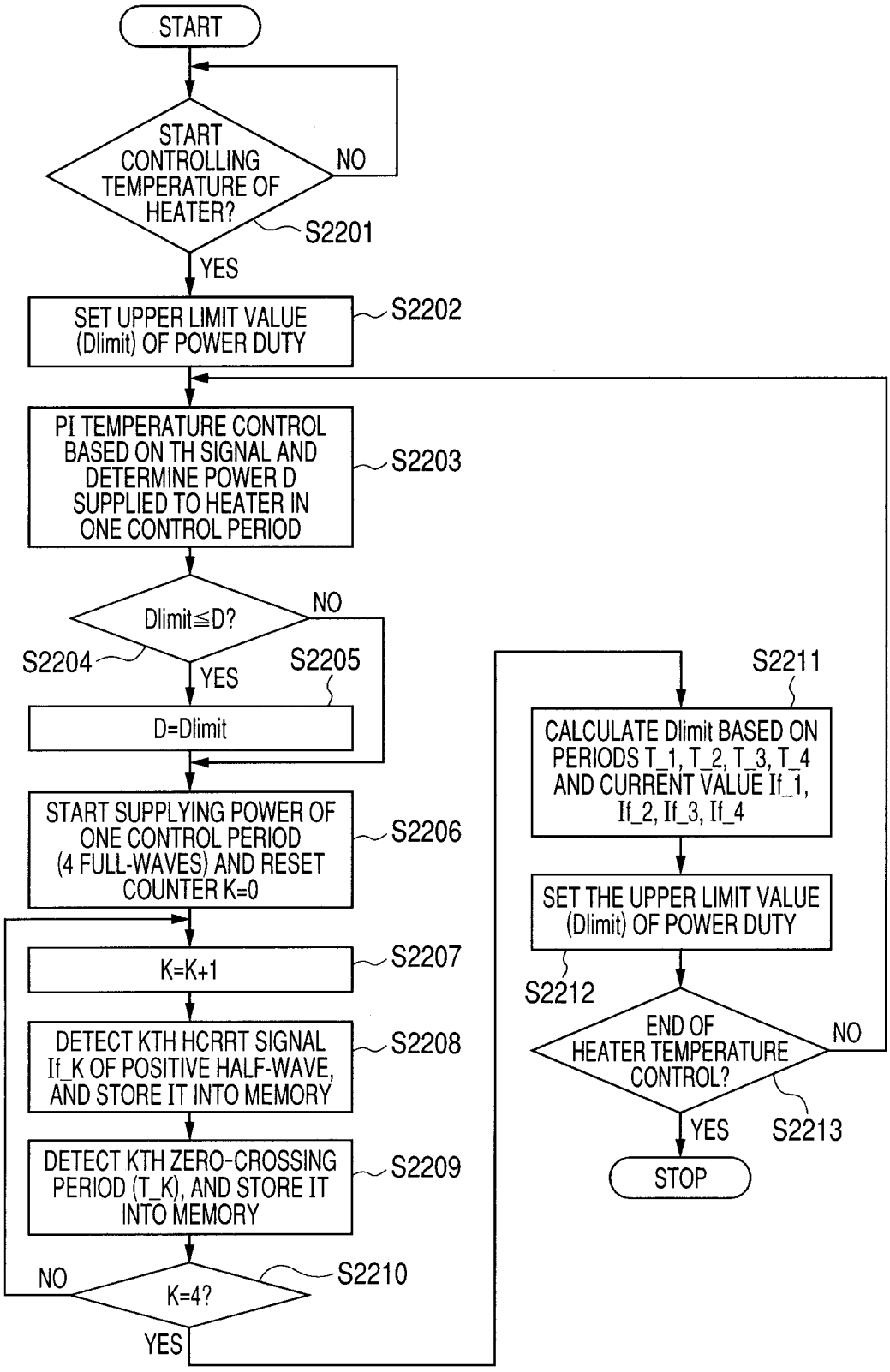
FIG. 18 is a flowchart for describing temperature control according to the second embodiment.

Next, a control sequence of the fixing apparatus 115 according to this embodiment is described. FIG. 18 is a flowchart for describing the control sequence of the fixing apparatus 115 performed by the CPU 309 according to this embodiment. A description is omitted of the partial control sequence (S2201 to S2210, S2212, and S2213) that is common with the control according to the first embodiment.

In S2211, the CPU 309 calculate the upper limit value Dlimit of the power duty based on the current values If_1 to If_4 for the 4 full-waves and the zero-crossing periods T_1 to T_4 which are stored in the CPU 309. Here, the value If_K notified by the HCRRT signal 606 is an integral value corresponding to a half-wave of the commercial frequency of the squared wave form as described above (see FIG. 6). With respect to the current value If_K at the frequency F_K Hz, the commercial frequency is set as a specific frequency, for example, 50 Hz is set as a reference frequency. The converted value of the current value If_K in terms of 50 Hz, which is assumed as I_K, is expressed as follows.

$$I_K = \mathrm{If}_K \times (F_K)/50$$

An updated value Dlimit of the upper limit power duty that allows energization is calculated from the current value I_K, the power duty D, and the upper limit current value Ilimit set in the CPU 309. The upper limit current value Ilimit is set as, for example, a value corresponding to the rated current of 15 A of the connected commercial power supply. Further, the value of the maximum current value Ipfc supplied to the parts other than the heater 202 is preset in the CPU 309. In this embodiment, the PFC current value Ipfc is set so that the value obtained by subtracting the PFC current value Ipfc from the upper limit current value Ilimit becomes the allowable current value (here, set as the converted value in terms of the frequency of 50 Hz) that may be supplied to the heater 202 in consideration of the power factor.

With regard to the values of the upper limit current value Ilimit and the PFC current value Ipfc, the value corresponding to the average value for one control period (8 half-waves) is stored in the memory within the CPU 309.

$$D\mathrm{limit} = (I\mathrm{limit} - Ipfc)/\{(I_1 + I_2 + I_3 + I_4)/4 - Ipfc\} \times D$$

In this embodiment, in the case of the power duties D of 7/12 to 12/12, (I_1+I_2+I_3+I_4)/4>>Ipfc is assumed to be satisfied.

If the anticipated AC input voltage range, the resistance value of the heater 202, and the like are taken into consideration, in a case where the power duty D is equal to or less than 6/12, there is no need to update the upper limit value Dlimit, which eliminates the need for the calculation of S2211.

The CPU 309 calculates the power duty of the power supplied to the heater 202 by repeatedly performing the above-mentioned processing in S2212 every 4 periods of the commercial power supply until the temperature control of the heater 202 ends.

As described in this embodiment, the method for alleviating the current detection error described in the first embodiment is also effective for detecting the current that combines the heater current Ih and the PFC current Ipfc. Accordingly, as in the wave form 7 of FIG. 17A, the influence of the distortion by the current detection transformer 1712 may be alleviated by generating the negative distortion generated by allowing energization from the positive energization cycle in one control period and the positive distortion generated by allowing energization from the negative energization cycle in one control period.

According to this embodiment, the precision in the current detection may be improved in the case of controlling the supply power by combining the phase control and the wave number control.

Third Embodiment

In a third embodiment of the present invention, description of the structure, the configuration, and the control that are common with the first embodiment is omitted. The third embodiment is described by using the same reference symbols for the same components as those of the first embodiment.

(Control of Power Supplied to Ceramic Heater)

Figure 19:
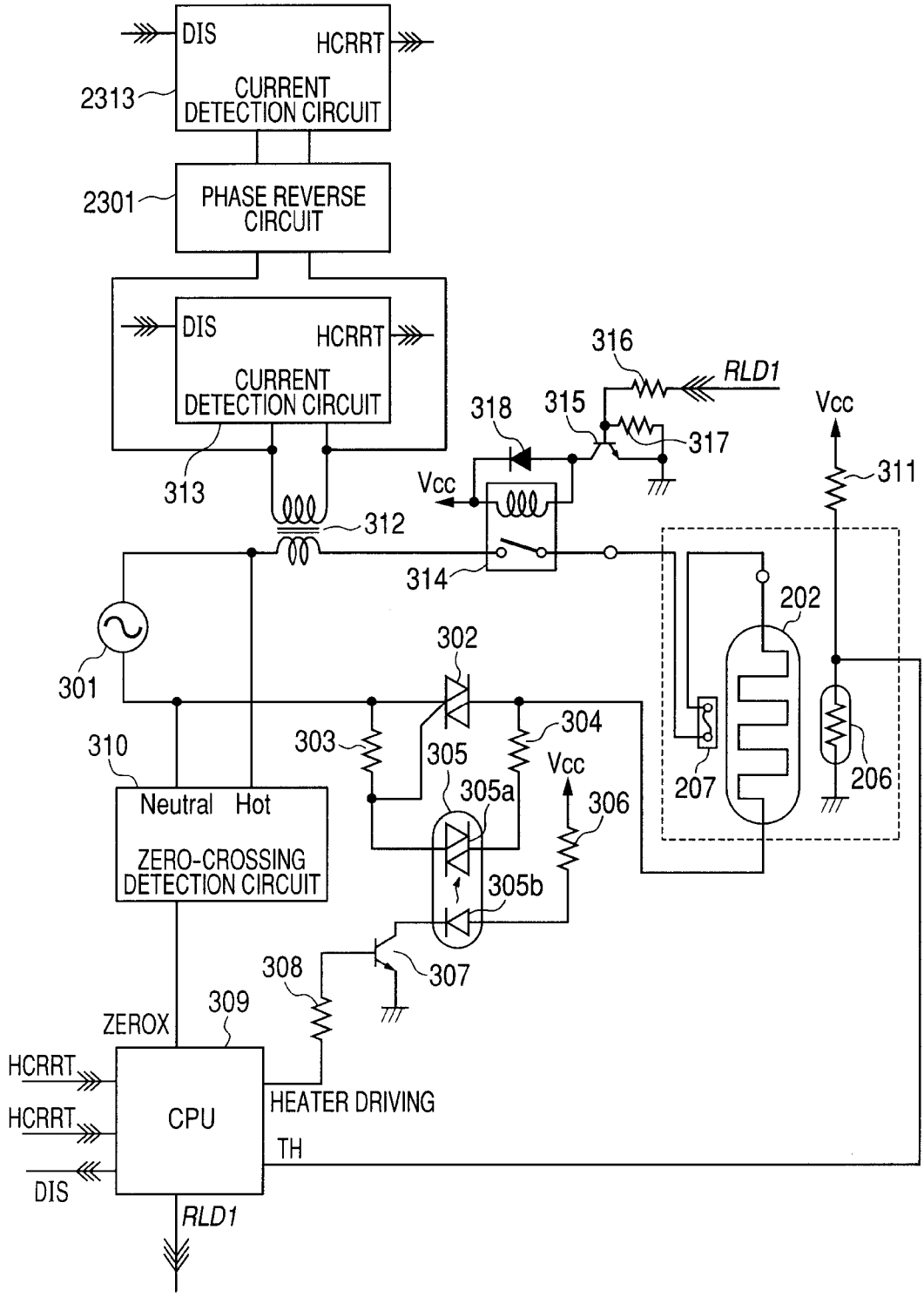
FIG. 19 is a configuration diagram of a heater driving circuit of the fixing apparatus according to the third embodiment.

FIG. 19 illustrates the driving circuit and the control circuit of the heater 202 according to the third embodiment. The current detection transformer 312 voltage-transforms a current on the primary side caused to flow to the heater 202, and performs an input to the current detection circuit 313 on the secondary side. The current detection circuit 313 performs the same operation as in the first embodiment as described with reference to FIGS. 5 and 6, and hence the description thereof is omitted. The secondary-side output from the current detection transformer 312 is input to a current detection circuit 2313 via a phase reverse circuit 2301. That is, the positive half-wave current may be detected by the current detection circuit 313, and the negative half-wave current may be detected by the current detection circuit 2313.

(Current Detection Circuit 2313)

Figure 20:
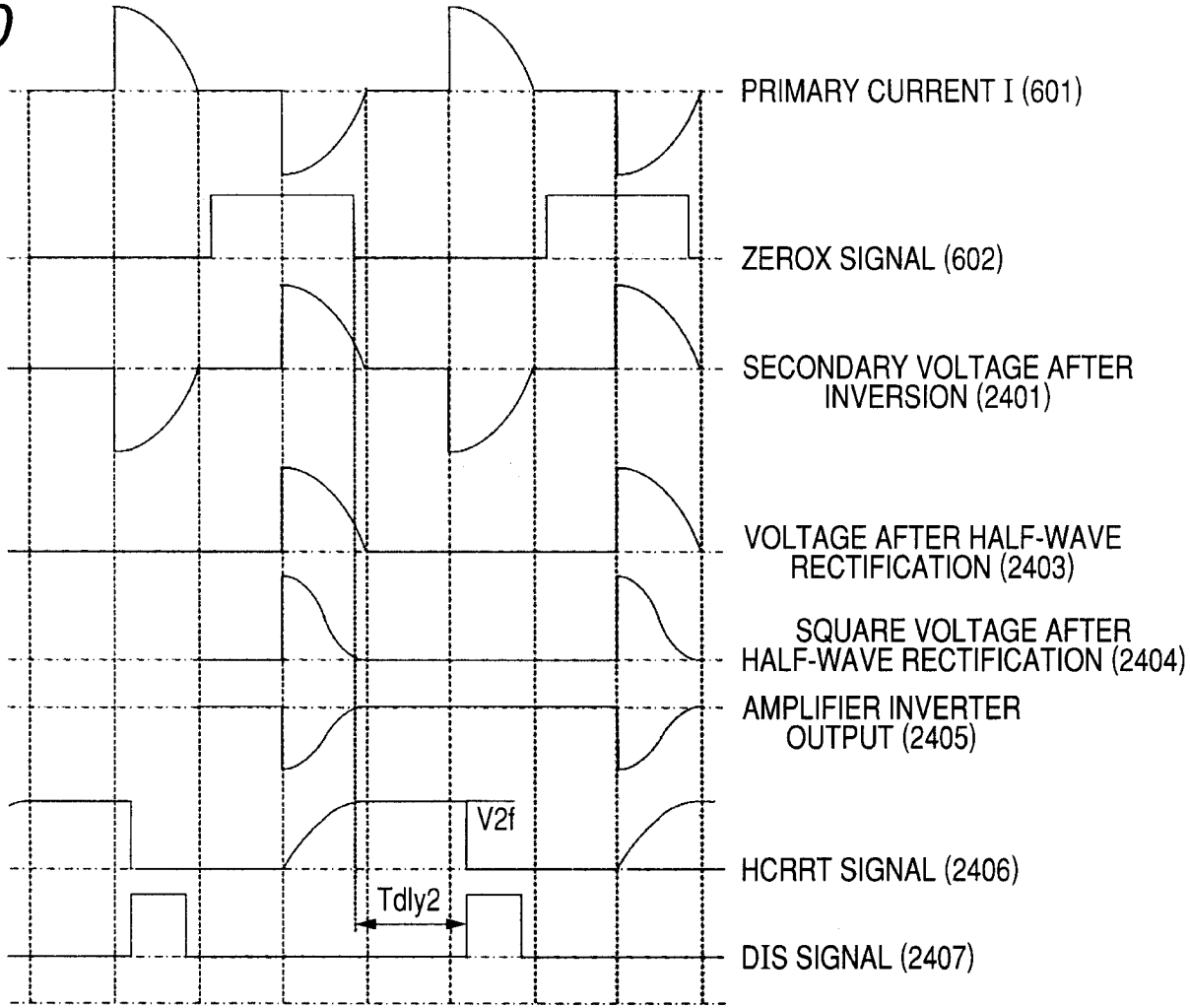
FIG. 20 is a wave form diagram of the current detection circuit according to the third embodiment.

FIG. 20 is a wave form diagram for describing an operation of the current detection circuit 2313. In FIG. 20, when the current I 601 is caused to flow in the heater 202, the current detection transformer 312 voltage-transforms the current wave form on the secondary side. The phase reverse circuit 2301 inverts the output voltage of the current detection transformer 312, and performs an input to the current detection circuit 2313 to obtain a secondary voltage after inversion 2401.

As illustrated in FIG. 5, the inversion output is rectified by the diodes 501*a* and 503*a*. The resistors 502*a* and 504*a* are connected thereto as the load resistors. FIG. 20 illustrates a wave form of the voltage 2403 obtained by the half-wave rectification by the diode 503*a*. The voltage wave form is input to the multiplier 506*a* via the resistor 505*a*. As illustrated in FIG. 20, the multiplier 506*a* outputs a wave form of a square voltage 2404. The wave form of the square voltage is input to the "−" terminal of the operational amplifier 509*a* via the resistor 507*a*. The reference voltage 584*a* is input to the "+" terminal of the operational amplifier 509*a* via the resistor 508*a*, and the output is inverted and amplified by the feedback resistor 560*a*. Note that, the operational amplifier 509*a* has the power supplied from the single power supply.

FIG. 20 illustrates a wave form of an amplified inverted output 2405 based on the reference voltage 584*a*. The output from the operational amplifier 509*a* is input to the "+" terminal of the operational amplifier 572*a*. The operational amplifier 572*a* controls the transistor 573*a* so that the current determined by the voltage difference between the reference voltage 584*a* and the voltage of the wave form input to the "+" terminal thereof and the resistor 571*a* is caused to flow in the capacitor 574*a*. In such a manner, the capacitor 574*a* is charged with the current determined by the voltage difference between the reference voltage 584*a* and the voltage of the wave form input to the "+" terminal of the operational amplifier 572*a* and the resistor 571*a*. After the end of the segment for the half-wave rectification carried out by the diode 503*a*, there is no charging current to the capacitor 574*a*, and hence the voltage value thereof is peak-held.

Then, as illustrated in FIG. 20, the DIS signal 2407 sent from the CPU 309 is used to turn on the transistor 575*a* in the half-wave rectification period of the diode 501*a*. Accordingly, the charged voltage of the capacitor 574*a* is discharged. As illustrated in FIG. 20, the transistor 575*a* is turned on/off by the DIS signal 2407 sent from the CPU 309, and the on/off control of the transistor 575*a* is performed based on the ZEROX signal 602. The DIS signal is turned on after a predetermined time Tdly2 has elapsed after the rising edge of the ZEROX signal, and is turned off before the rising edge of the next negative energization cycle. The control timing of the transistor 575*a* is determined based on a ZEROX period detected from the rising edge and the falling edge of the ZEROX signal. This allows the control to be performed without interfering with the energization period of the heater 202 which is the half-wave rectification period of the diode 503*a*. That is, a peak-hold voltage V2*f* (I2*f*) of the capacitor 574*a* is the integral value, corresponding to a half period, of the squared value of the wave form obtained by voltage-transforming the current wave form to the secondary side by the current detection transformer 312.

Accordingly, the voltage value peak-held by the capacitor 574*a* is sent from the current detection circuit 2313 to the CPU 309 as an HCRRT signal 2406. The voltage-transformed heater current wave form is converted into an effective value or a squared value thereof, and is A/D-input to the CPU 309 as the HCRRT signal. The positive half-wave of the primary current 601 may be current-detected by the current detection circuit 313 based on the HCRRT signal I1*f* 606 of FIG. 6. Further, the negative half-wave of the primary current 601 may be current-detected by the current detection circuit 2313 based on the HCRRT signal I2*f* 2406 of FIG. 20.

(Results of Simulation Using Equivalent Circuit)

Figure 23:
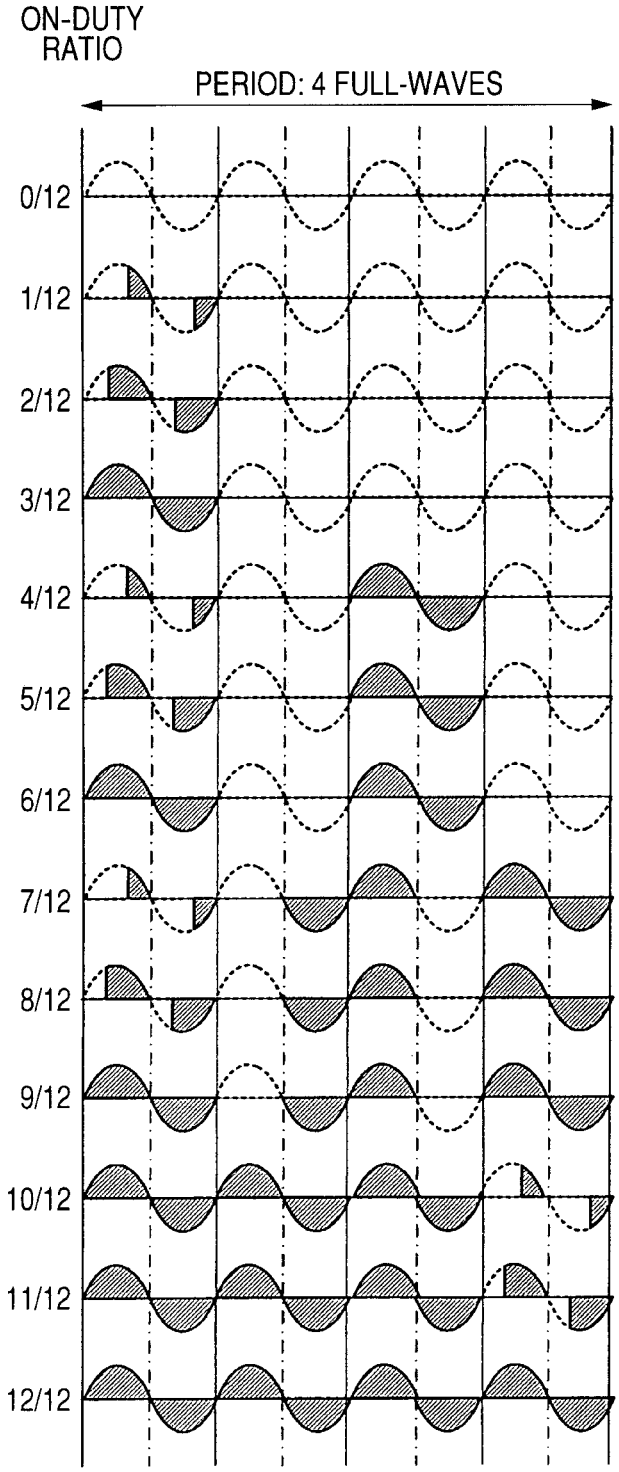
FIG. 23 is a diagram illustrating control patterns of heater power control according to the third embodiment.

FIG. 21A illustrates simulation wave forms used in the equivalent circuit diagram of FIG. 11. Here, the control patterns of FIG. 23 are described by focusing attention on the wave form of the power duty 7/12 (=58.3%). The HCRRT signal having no distortion caused by the current detection transformer 312 or no error in the current detection exhibits a value proportionate to one of the squared value of the effective current value on the primary side of the current detection transformer and the power supplied to the load on the primary side. However, when the load on the primary side of the current detection transformer fluctuates, as in the wave form 1 of FIG. 12A, distortion occurs in the voltage wave form output to the secondary side of the current detection transformer 312. The distortion of the voltage wave form lowers the detection precision of the current detection circuit. For comparison purposes, the wave form 2 indicates a voltage wave form generating no distortion.

A table of FIG. 21B indicates output values of the HCRRT signals output by the current detection circuit 313 and the current detection circuit 2313 with regard to a wave form 9 and a wave form 10 of FIG. 21A. The current detection circuit 2313 outputs the HCRRT signal corresponding to the negative half-wave [1], and the current detection circuit 313 outputs the HCRRT signal corresponding to the half-wave [2].

The half-wave in the positive phase and the half-wave in the negative phase are current-detected by the current detection circuit 313 and the current detection circuit 2313, respectively. The output of the HCRRT signal corresponding to the half-wave [1] of the wave form 9 illustrated in FIG. 21A is found to exhibit an output value lower than the wave form 10. In a case where the load on the primary side of the current detection transformer increases in the negative energization cycle as in the half-wave [1], the positive wave form distortion is generated. As illustrated in FIG. 20, the half-wave [1] indicates that the secondary output of the current detection transformer 312 is inverted, and the secondary voltage after inversion 2401 is input to the current detection circuit 2313. Therefore, the output of the HCRRT signal corresponding to the half-wave [1] decreases. Further, the output of the HCRRT signal corresponding to the half-wave [2] of the wave form 9 is found to exhibit an output value higher than the wave form 10. In a case where the load on the primary side of the current detection transformer 312 increases in the negative energization cycle as in the half-wave [1], the positive wave form distortion is generated. The half-wave [2] is subject to the influence of the positive wave form distortion generated at the half-wave [1], and hence the output of the HCRRT signal corresponding to the half-wave [2] increases. If the average value of the output values of the HCRRT signal corresponding to the half-waves [1] and [2] of the wave form 9 is calculated, the error of approximately −13% occurs with respect to the average value of the wave form 10 in which no distortion is generated by the current detection transformer 312.

From the detection results of the HCRRT signal corresponding to the half-wave [1] and the half-wave [2], the value proportionate to one of the squared value of the effective current value on the primary side of the current detection transformer and the power supplied to the load on the primary side with regard to the 4 full-waves corresponding to one control period according to this embodiment may be calculated by the following equation.

(Conversion Average Value of HCRRT Signal for One Control Period)=((HCRRT Output of Half-Wave [1])+(HCRRT Output of Half-Wave [2]))2×(Power Duty for One Control Period (7/12 in this Case))/(Power Duty of Half-Waves [1] and [2] (1/1 in this Case))

Accordingly, in the method combining the phase control and the wave number control, the fluctuation in the load current is larger than the conventional phase control because the phase control and the wave number control are changed over in one control period, and hence it is difficult to detect a current with accuracy. Therefore, this embodiment proposes the above-mentioned method combining the phase control and the wave number control for improving the precision in the current detection.

In the control pattern examples used in this embodiment illustrated in FIG. 23, current wave forms suitable for the current detection method proposed in this embodiment are used for the power duties 1/12 to 9/12. In this embodiment, in the wave forms of the power duties 10/12 to 12/12, there is little influence of the distortion due to the current detection transformer because the heater 202 is almost always in an on state with the load fluctuation on the primary side being small. Within the range of the power duties 10/12 to 12/12, even without using the control pattern proposed in this embodiment, necessary detection precision may be obtained. According to the control of this embodiment, the error of the current detection precision may be alleviated if there is a control pattern in which the energization starts from the positive or negative energization cycle followed by the energization of the negative or positive half-wave. The precision in the current detection may be improved even if the negative or positive half-wave of the control pattern for correction by the method of this embodiment is not the half-wave of a 100% duty but, for example, the half-wave of an 80% duty. A larger number of circuits are necessary and the control is more complicated than in the first and second embodiments, but there are many current detection patterns that allow the correction of the current detection precision. In the control pattern examples of this embodiment, the error of the current detection precision may be alleviated within the range of the power duties 1/12 to 9/12.

(Temperature Control of Heater According to this Embodiment)

Figures 22, 22A:
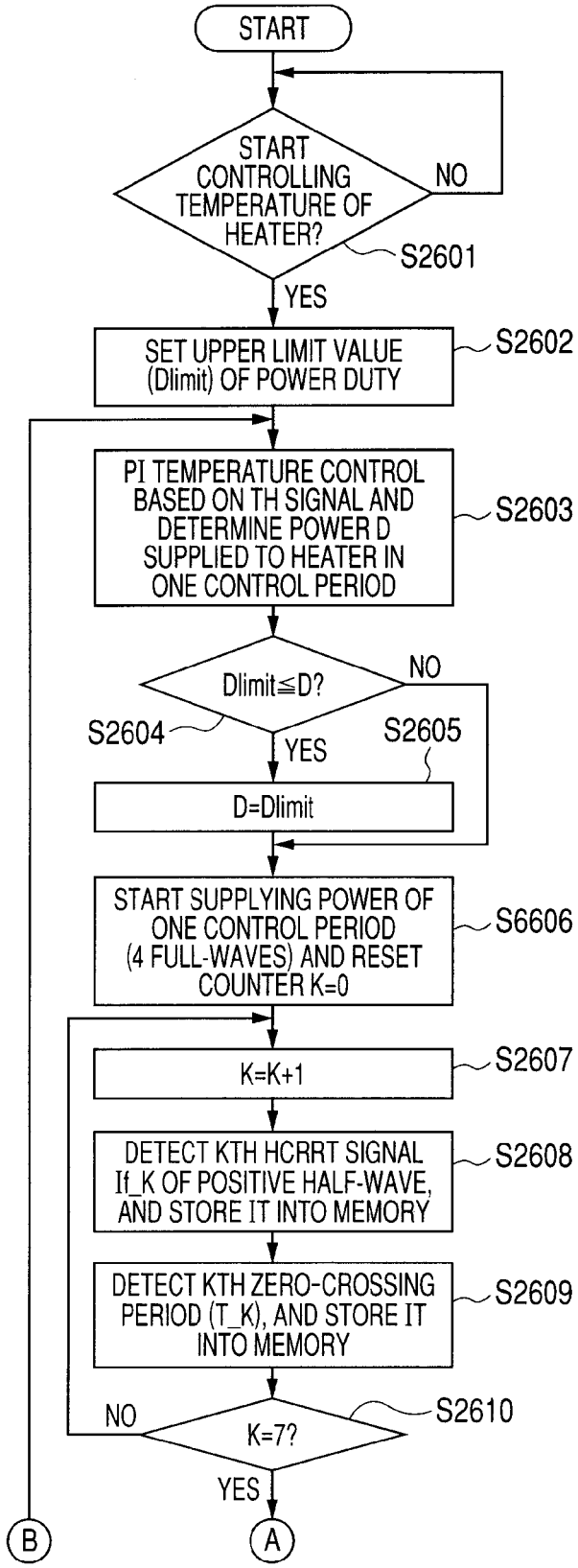
FIG. 22 is comprised of FIGS. 22A and 22B are flowcharts for describing temperature control according to the third embodiment.
Figure 22B:
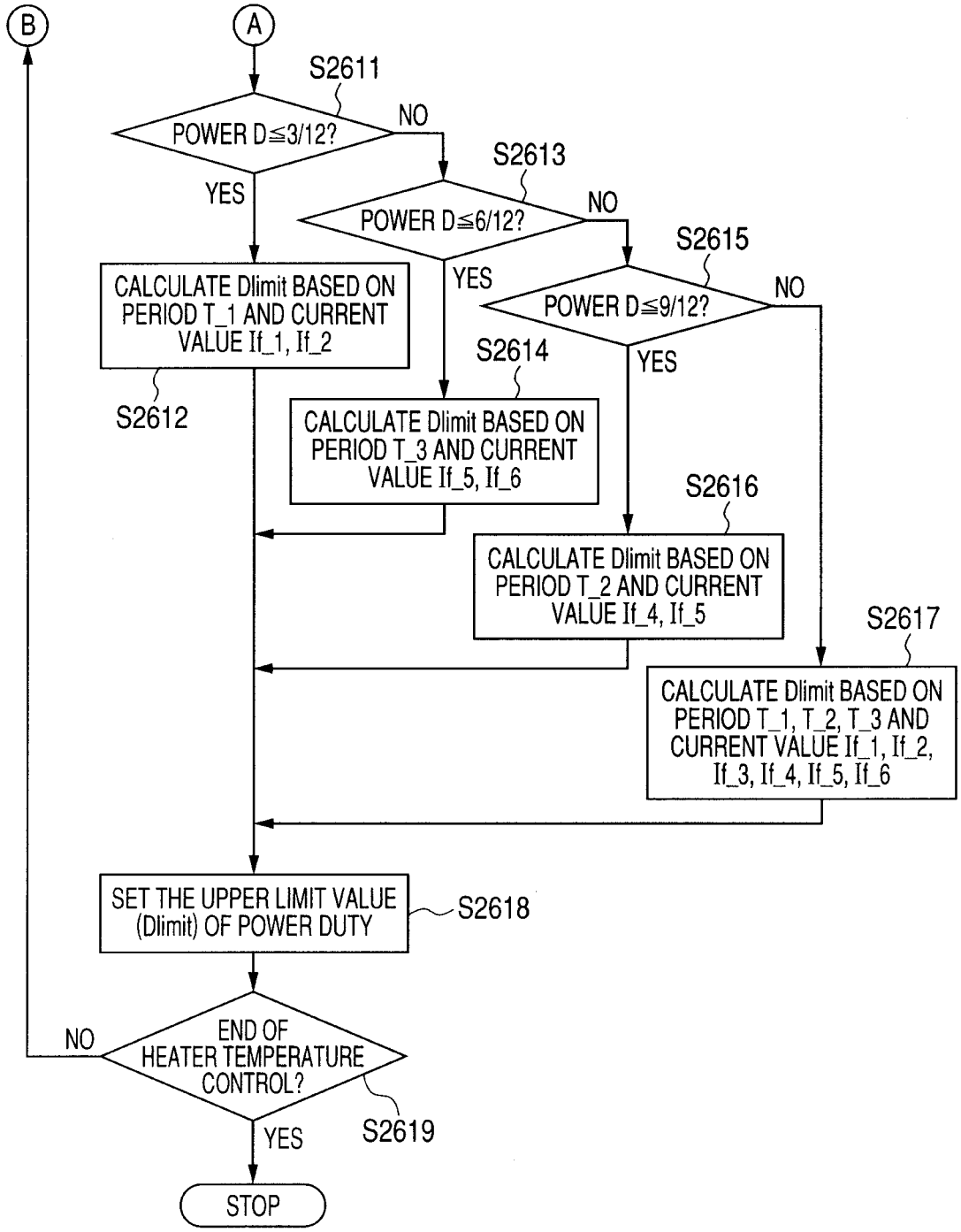

FIGS. 22A and 22B are flowcharts for describing a control sequence of the fixing apparatus 115 performed by the CPU 309 according to this embodiment. S2601 to S2610 are the control common with those of FIG. 14 according to the first embodiment, and hence the description thereof is omitted. However, in this embodiment, the current detection is performed at two continuing half-waves by the current detection circuit 313 and the current detection circuit 2313, and hence the current detection is performed at 8 half-waves in one control period. Therefore, in this embodiment, the counter K is set to count 8 half-waves, and the current detection values corresponding to 8 half-waves are stored into the memory, after which the upper limit power duty Dlimit is calculated. Note that, as described later, a current value If_8 is hard to capture into the control in terms of sequence, and hence "K=7" is set as a judgment condition in S2610.

In S2611, the CPU 309 determines whether or not the power duty D determined in S2605 is equal to or less than 3/12. If the power duty D is one of the current control patterns of 0/12 to 3/12, the procedure advances to S2612.

In S2612, the CPU 309 calculates the upper limit value Dlimit based on the current values If_1 and If_2 for the 2 half-waves and the ZEROX period T_1 which are stored in the memory within the CPU 309. Here, the value If_K notified by the HCRRT signal is an integral value corresponding to a half-wave of the commercial frequency of the squared wave form as described above. With respect to the current value If_K at the frequency F Hz, the commercial frequency is set as a specific frequency, for example, 50 Hz is set as a reference frequency. The converted value of the current value If_K in terms of 50 Hz, which is assumed as I_K, is expressed as follows.

$$I_K = \mathrm{If}_K \times F/50$$

An updated value Dlimit of the upper limit power duty that allows energization is calculated from the current value I_K, the power duty D, and the upper limit current value Ilimit set in the CPU 309. The upper limit current value Ilimit may be set as, for example, the allowable current value of the one control period (here, set as the converted value in terms of the frequency of 50 Hz) that may be supplied to the heater which is obtained by subtracting the current supplied to the parts other than the heater from the rated current of the connected commercial power supply, or the maximum current value necessary for the control. In this embodiment, the upper limit of the average value for one control period corresponding to the 8 half-waves is set as the upper limit current value Ilimit.

$$F = 1/T_1$$

$$I_K = \mathrm{If}_K \times F/50$$

$$D\mathrm{limit} = 2 \times I\mathrm{limit}/(I_1 + I_2) \times D$$

If the CPU 309 determines in S2611 that the power duty D is larger than 3/12, the procedure advances to the processing of S2613. In S2613, the CPU 309 determines whether or not the power duty D determined in S2605 is equal to or less than 6/12. If the CPU 309 determines that the power duty D is one of the current control patterns of 4/12 to 6/12, the procedure advances to S2614. In S2614, the CPU 309 calculates the upper limit value Dlimit based on the current values If_5 and If_6 for the 2 half-waves and the ZEROX period T_3 which are stored in the memory within the CPU 309.

$$F = 1/T_3$$

$$I_K = \mathrm{If}_K \times F/50$$

$$D\mathrm{limit} = 2 \times I\mathrm{limit}/(I_5 + I_6)$$

If the CPU 309 determines in S2613 that the power duty D is larger than 6/12, the procedure advances to the processing of S2615. In S2615, the CPU 309 determines whether or not the power duty D determined in S2605 is equal to or less than 9/12. If the CPU 309 determines that the power duty D is one of the current control patterns of 7/12 to 9/12, the procedure advances to S2616. In S2616, the CPU 309 calculates the upper limit value Dlimit based on the current values If_4 and If_5 for the 2 half-waves and the ZEROX period T_2 which are stored in the memory within the CPU 309.

$$F = 1/T_2$$

$$I_K = \mathrm{If}_K \times F/50$$

$$D\mathrm{limit} = 2 \times I\mathrm{limit}/(I_4 + I_5)$$

If the CPU 309 determines in S2615 that the power duty D is larger than 9/12, the procedure advances to the processing of S2617. If the CPU 309 determines in S2615 that the determined power duty D is one of the current control patterns of 10/12 to 12/12, the procedure advances to S2617. In S2617, the CPU 309 calculates the upper limit value Dlimit based on the current values If_1 to If_7 for the 8 half-waves and the ZEROX period T_1 to T_3 which are stored in the memory within the CPU 309. The ZEROX period T_4 and the current value If_8 are hard to capture into the control in terms of sequence, and hence the current values If_1 to If_6 and the ZEROX periods T_1 to T_3 are used in this embodiment. Here, a frequency F is calculated from the average value of the commercial frequencies T_1 to T_3. Assuming that the converted value of the current value If_K in terms of the frequency of 50 Hz is I_K, the following equations are satisfied.

$$F = (1/T_1 + 1/T_2 + 1/T_3)/3$$

$$I_K = \mathrm{If}_K \times F/50$$

$$D\mathrm{limit} = 6 \times I\mathrm{limit}/(I_1 + I_2 + I_3 + I_4 _ I_5 + I_6)$$

The CPU 309 calculates the power duty of the power supplied to the heater 202 by repeatedly performing the above-mentioned processing every 4 periods of the commercial power supply in S2619 until the temperature control of the heater 202 ends.

According to this embodiment, the precision in the current detection may be improved in the case of controlling the supply power by combining the phase control and the wave number control.

Fourth Embodiment

In a fourth embodiment of the present invention, the description of the structure, the configuration, and the control that are common with the first embodiment is omitted. The fourth embodiment is described by using the same reference symbols for the same components as those of the first embodiment.

(Current Detection Circuit)

Figure 24:
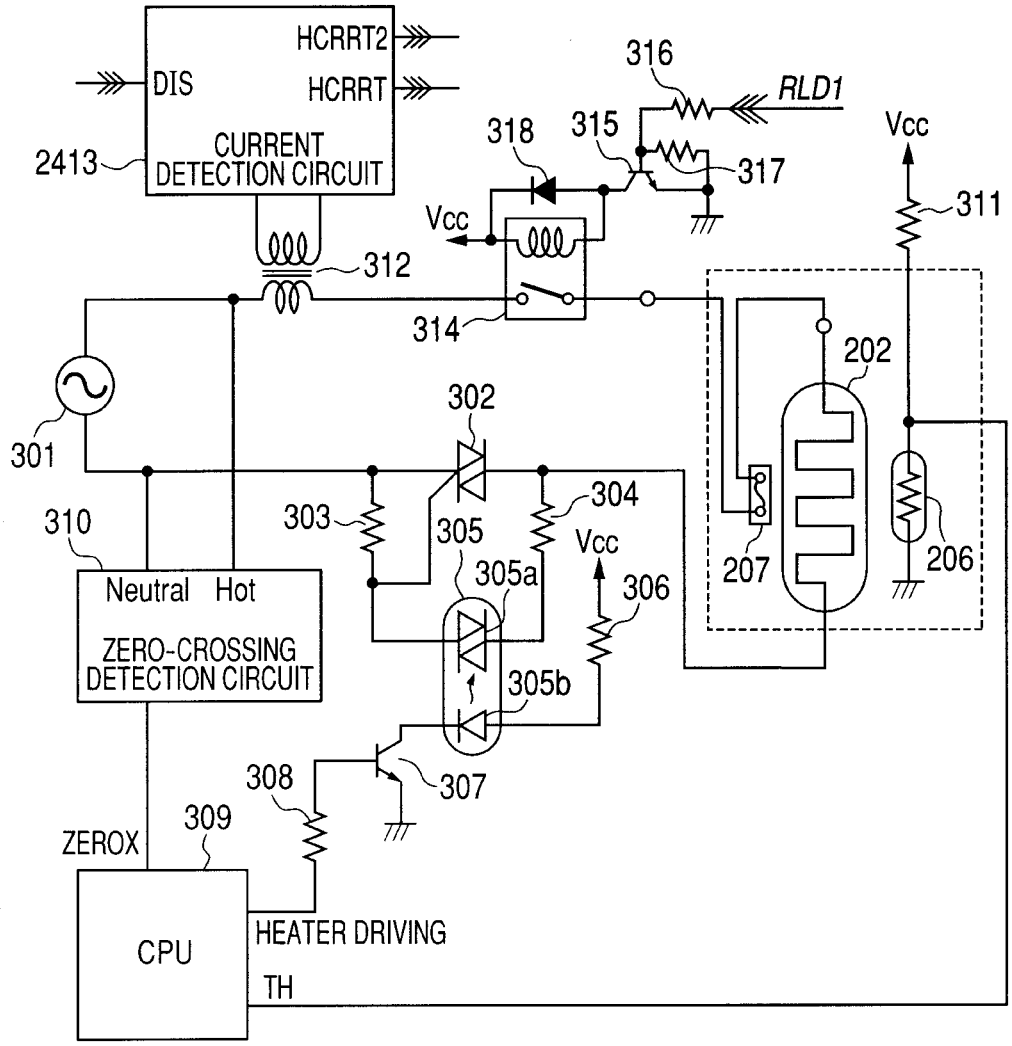
FIG. 24 is a configuration diagram of a heater driving circuit of a fixing apparatus according to a fourth embodiment.

FIG. 24 illustrates a case of using a current detection circuit 2413 different from that of the first embodiment. The current detection circuit 2413 includes two outputs for the HCRRT signal and an HCRRT2 signal. The HCRRT signal is identical to that of the first embodiment, and hence description thereof is omitted.

Figure 25A:
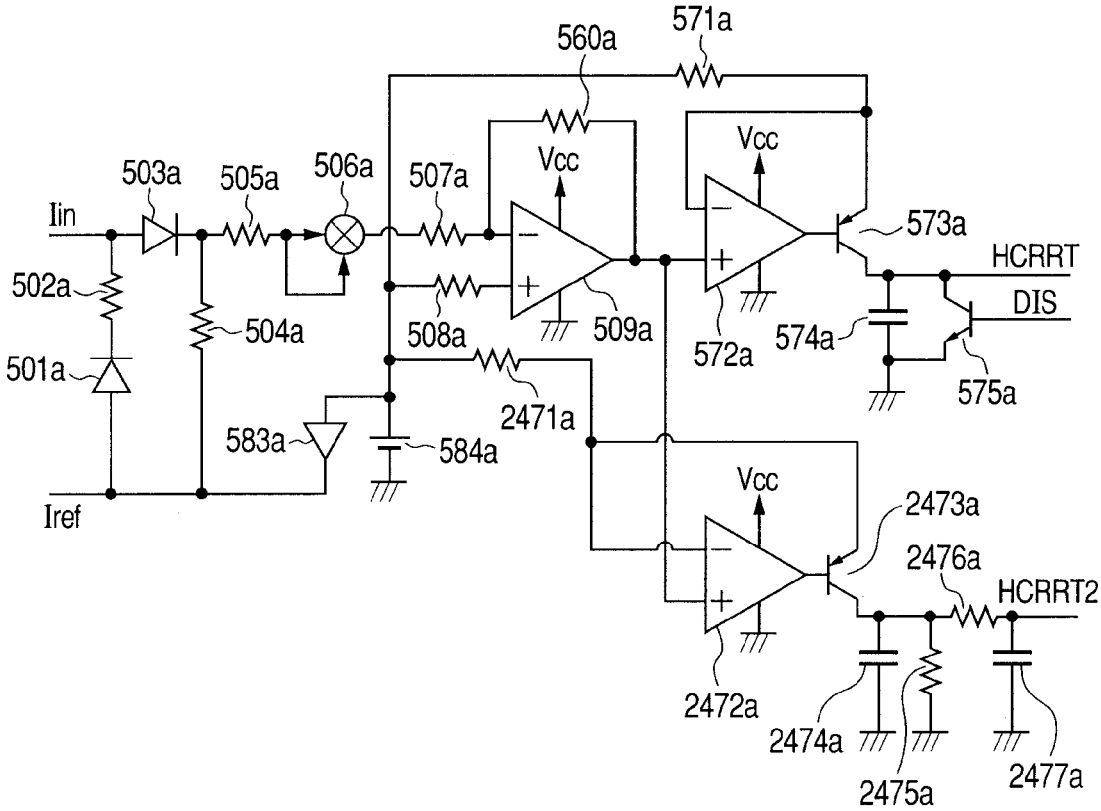
FIGS. 25A and 25B are configuration diagrams of a current detection circuit according to the fourth embodiment.
Figure 25B:
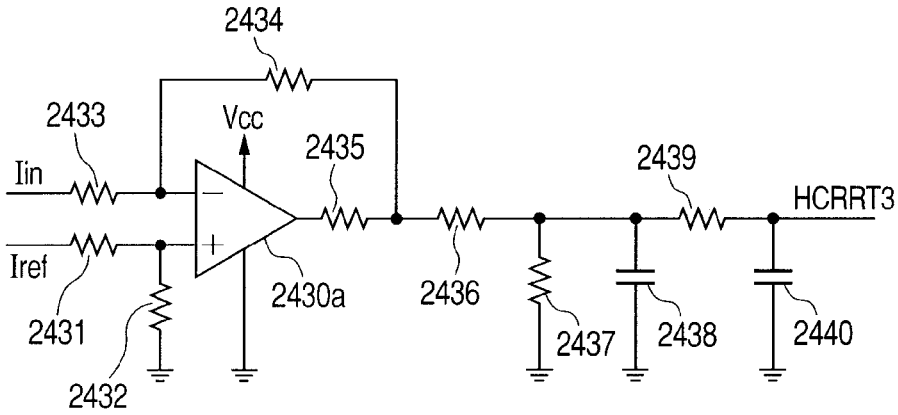

FIGS. 25A and 25B are detailed diagrams of the current detection circuit 2413. The HCRRT2 signal is described with reference to FIGS. 25A and 25B and the waveforms illustrated in FIG. 6. The wave form of the square voltage 604 illustrated in FIG. 6 is input to the "−" terminal of the operational amplifier 509*a* via the resistor 507*a*. The reference voltage 584*a* is input to the "+" terminal of the operational amplifier 509*a* via the resistor 508*a*, and the output is inverted and amplified by a feedback resistor 560*a*. Note that, the operational amplifier 509*a* has power supplied from the single power supply. FIG. 6 illustrates the wave form of the amplified inverted output 605 based on the reference voltage 584*a*. The output from the operational amplifier 509*a* is input to the "+" terminal of an operational amplifier 2472*a*. The operational amplifier 2472*a* controls a transistor 2473*a* so that the current determined by a voltage difference between the reference voltage 584*a* and the voltage of the wave form input to the "+" terminal thereof and a resistor 2471*a* is caused to flow in a capacitor 2474*a*. In such a manner, the capacitor 2474*a* is charged with the current determined by the voltage difference between the reference voltage 584*a* and the voltage of the wave form input to the "+" terminal of the operational amplifier 2472*a* and the resistor 2471*a*. the charged voltage of the capacitor 2474*a* is discharged via a discharging resistor 2475*a*. A capacitor 2477*a* and a resistor 2476*a* are smoothing circuits. The HCRRT2 signal is a value obtained by performing moving average on the squared value of the wave form obtained by voltage-transform to the secondary side by the current detection transformer 312.

Further, as in the circuit illustrated in FIG. 25B, the wave form pattern proposed in this embodiment is also effective for a case of performing moving average on the wave form obtained by voltage-transform to the secondary side by the current detection transformer 312. FIG. 25B illustrates an example of a current sensing unit. If the negative half-wave current value flowing on the primary side of the current detection transformer 312 becomes large, the amplitude of the wave form of the primary current 601 illustrated in FIG. 6 becomes large, and Iin has a lower voltage value than Iref. An operational amplifier 2430*a* is used as a differential amplifier circuit. An amplification factor of the differential amplifier circuit may be defined by a ratio of (resistor 2434)/(resistor 2433) and (resistor 2432)/(resistor 2431). A resistor 2435 is a protective resistor for the operational amplifier 2430*a*. The wave form inverted and amplified by the operational amplifier 2430*a* is smoothed by a filter circuit at a subsequent stage. The amplified inverted wave form is charged in a capacitor 2438 via a resistor 2436. A resistor 2437 is a discharging resistor. The voltage wave form of a capacitor 2438 is smoothed by a resistor 2439 and a capacitor 2440, and is output as an HCRRT3 signal.

The HCRRT3 signal has lower sensing precision of the effective current value than the HCRRT2 signal because the output proportionate to the current average value is obtained, but may be realized by a simple circuit configuration. Depending on the required current sensing precision, the HCRRT3 signal may be used instead of the HCRRT2 signal.

Even if the current is detected by such a current detection circuit as illustrated in FIGS. 25A and 25B, by using such waveforms as illustrated in FIG. 10, the precision in the current detection may be improved.

Fifth Embodiment

Figure 26A:
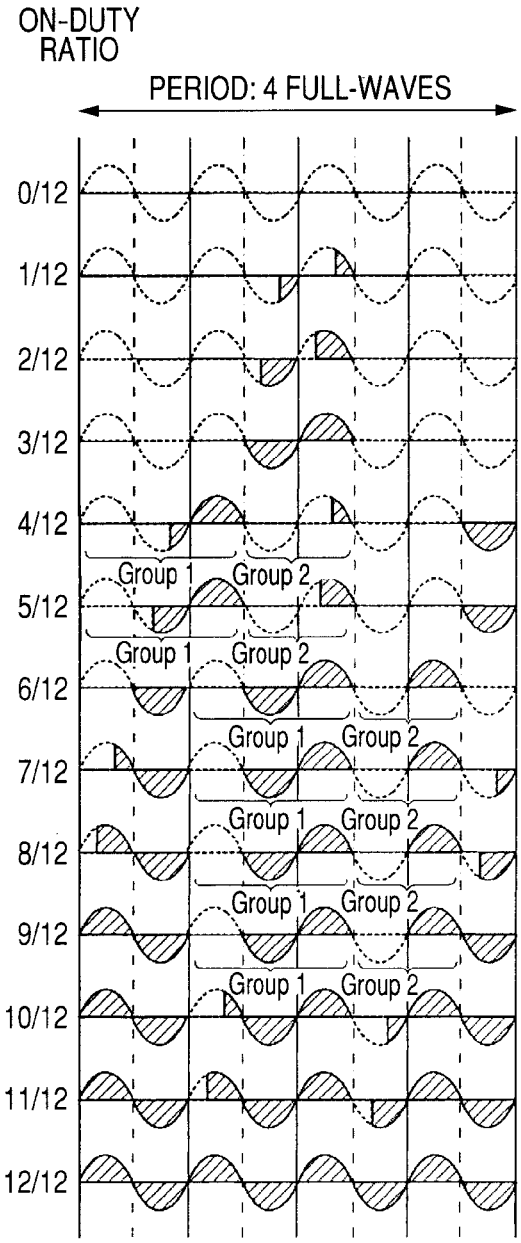
FIGS. 26A and 26B are diagrams illustrating control patterns of heater power control according to a fifth embodiment.
Figure 26B:
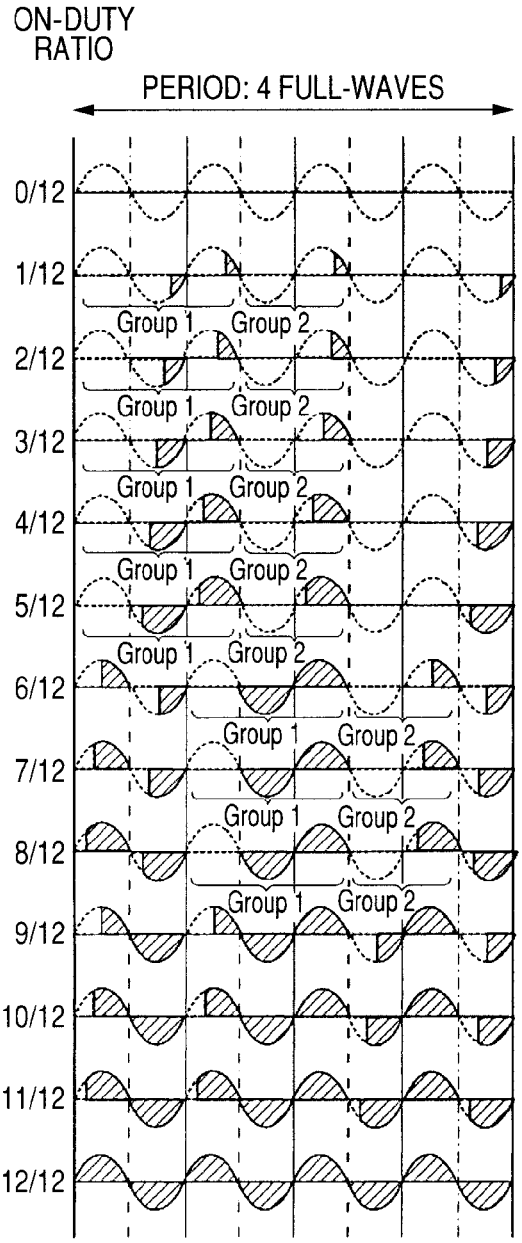

FIGS. 26A and 26B illustrate other wave form examples of the heater power control which may improve the precision in the current detection.

FIG. 26A illustrates a control pattern in which the phase control wave form is kept equal to or less than 1 full-wave out of 4 full-waves (2 half-waves out of 8 half-waves). FIG. 26B illustrates a control pattern in which the phase control wave form is kept equal to or less than 2 full-waves out of 4 full-waves (4 half-waves out of 8 half-waves). Alternatively, if the phase control wave form is to be kept equal to or less than 3 full-waves out of 4 full-waves (6 half-waves out of 8 half-waves), the wave forms of FIG. 26A and the wave forms of FIG. 26B may be output alternately control period by control period. By thus using the two control patterns, a ratio of the phase control wave forms to the wave number control wave forms may be set arbitrarily. The set wave forms corresponding to the power ratios illustrated in FIGS. 26A and 26B also include: the first group of the positive half-wave at which the entirety of one half-wave is turned off, the negative half-wave at which at least a portion of a half-wave is turned on, and the positive half-wave at which at least a portion of a half-wave is turned on, which are arranged in the stated order immediately one after another; and the second group of the negative half-wave at which the entirety of one half-wave is turned off and the positive half-wave at which at least a portion of a half-wave is turned on, which are arranged in the stated order immediately one after another.

As described in this embodiment, by using the two control patterns that may improve the precision in the current detection, the ratio of the phase control wave form (half-wave at which a portion of a half-wave is turned on) may be changed while producing the effect of improving the precision in the current detection. As a result, harmonic noise is easy to suppress.

Note that, the above-mentioned first to fifth embodiments are described by setting 4 full-waves as one control period, but may be applied to a case where a predetermined number (note that, wave number that may include both the first group and the second group) of continuing half-waves in the AC wave form are set as one control period, for example, 5 full-waves are set as one control period. Accordingly, in a case where 3 or more full-waves are set as one control period, if the wave form including the first group and the second group is set as the wave form of at least one power ratio of a plurality of power ratios, the precision in the current detection may be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-137149, filed Jun. 8, 2009, and No. 2010-103763, filed Apr. 28, 2010, which are hereby incorporated by reference herein in their entirety.

What is claimed is:

1. An image forming apparatus, comprising:

a fixing part configured to heat-fix an unfixed toner image formed on a recording material to the recording material, the fixing part comprising a heater that generates heat by power supplied from a commercial AC power supply;

a temperature sensing element configured to sense a temperature of the fixing part;

a power control part configured to control the power supplied from the commercial AC power supply to the heater according to the temperature sensed by the temperature sensing element, wherein the power control part selects a power level of a control pattern from a plurality of power levels of control patterns according to the sensed temperature per a segment of a control period, the duration of a segment of the control period being determined by a predetermined number of consecutive half-cycles in an AC wave form, and the plurality of power levels depends on a combination of a phase control pattern and a wave number control pattern; and a current detection part provided in a power supply path from the commercial AC power supply to the heater, configured to detect a current flowing in the power supply path, the current detection part comprising a transformer and a current detection circuit configured to detect the current via the transformer, wherein the current detection part is further configured to detect current corresponding to the combination of phase control pattern and the wave number control pattern and at least a part of the plurality of power levels includes:

both a first group of wave forms in which power is supplied in both at least a part of a negative half-cycle and at least a part of a positive half-cycle in order just after the absence of supply of power during an entirety of a positive half-cycle, and a second group of wave forms in which power is supplied in at least a part of a positive half-cycle just after the absence of supply of power during an entirety of a negative half-cycle, or both a first group of wave forms in which power is supplied in both at least a part of a positive half-cycle and at least a part of a negative half-cycle in order just after the absence of supply of power during an entirety of a negative half cycle, and a second group of wave forms in which power is supplied in at least a part of a negative half-cycle just after the absence of supply of power during an entirety of one half of a positive half-cycle.

2. An image forming apparatus according to claim 1, wherein the current detection circuit includes a circuit configured to detect the current including only one of the positive half-cycle and the negative half-cycle in the AC wave form.

3. An image forming apparatus according to claim 1, further comprising a low voltage DC power supply circuit which derives power from the commercial AC power supply connected to a line branching from the power supply path from the commercial AC power supply to the heater, wherein the current detection part detects the current flowing in the power supply path on a commercial AC power supply side of a branch position between the heater and the low voltage DC power supply circuit.

4. An image forming apparatus according to claim 1, wherein the fixing part further comprises:

an endless belt having an inner surface in contact with the heater; and a pressure roller that forms a fixing nip portion for performing a fixing process on a recording material that bears the unfixed toner image together with the heater via the endless belt.

5. An image forming apparatus according to claim 1, wherein half-cycles contributing to supply power in the first group of wave forms and the second group of wave forms comprise the wave number control pattern.

6. An image forming apparatus, comprising:

a fixing part configured to heat-fix an unfixed toner image formed on a recording material to the recording material, the fixing part comprising a heater that generates heat by power supplied from a commercial AC power supply;

a temperature sensing element configured to sense a temperature of the fixing part;

a power control part configured to control the power supplied from the commercial AC power supply to the heater in one control pattern selected from a plurality of control patterns according to the temperature sensed by the temperature sensing element, wherein each of plurality of control patterns is defined as a number of wave forms in one control period defined as a predetermined number of continuing half-cycles in an AC wave form and the plurality of the control patterns depend on a combination of a phase control pattern and a wave number control pattern; and a current detection part provided in a power supply path from the commercial AC power supply to the heater, configured to detect a current flowing in the power supply path, the current detection part comprising a transformer and a current detection circuit for detecting the current via the transformer, wherein the current detection part is further configured to detect current corresponding to the combination of the phase control pattern and the wave number control pattern and at least a part of the plurality of the control patterns includes:

both a first group of wave forms in which power is supplied in both at least a part of a negative half-cycle and at least a part of a positive half-cycle in order just after the absence of supply of power during an entirety of a positive half-cycle, and a second group of wave forms in which power is supplied in at least a part of a positive half-cycle just after the absence of supply of power during an entirety of a negative half-cycle, or both a first group of wave forms in which power is supplied in both at least a part of a positive half-cycle and at least a part of a negative half-cycle in order just after the absence of supply of power during an entirety of a negative half cycle, and a second group of wave forms in which power is supplied in at least a part of a negative half-cycle just after the absence of supply of power during an entirety of a positive half-cycle.

7. An image forming apparatus according to claim 6, wherein the current detection circuit includes a circuit configured to detect the current including only one of the positive half-cycle and the negative half-cycle in the AC wave form.

8. An image forming apparatus according to claim 6, further comprising a low voltage DC power supply circuit which derives power from the commercial AC power supply connected to a line branching from the power supply path from the commercial AC power supply to the heater, wherein the current detection part detects the current flowing in the power supply path on a commercial AC power supply side of a branch position between the heater and the low voltage DC power supply circuit.

9. An image forming apparatus according to claim 6, wherein the fixing part further comprises:

an endless belt having an inner surface in contact with the heater; and a pressure roller that forms a fixing nip portion for performing a fixing process on a recording material that bears the unfixed toner image together with the heater via the endless belt.

10. An image forming apparatus according to claim 6, wherein the half-cycles contributing to supply power in the first group of wave forms and the second group of wave forms are the wave number control pattern.

11. An image forming apparatus, comprising:

a fixing part configured to heat-fix an unfixed toner image formed on a recording material to the recording material, the fixing part comprising only one heater that generates heat by power supplied from an AC power supply;

a temperature sensing element configured to sense a temperature of the fixing part;

a power control part configured to control the power supplied from the AC power supply to the heater in accordance with the temperature sensed by the temperature sensing element, wherein the power control part controls the power supplied to the heater with control patterns that depend on a combination of a phase control pattern and a wave number control pattern; and a current detection part provided in a power supply path from the AC power supply to the heater, configured to detect a current flowing in the heater, the current detection part comprising a transformer and a current detection circuit for detecting the current via the transformer, wherein a wave form of current flowing in the heater, controlled by the power control part includes:

both a first group of wave forms in which power is supplied in both at least a part of a negative half-cycle and at least a part of a positive half-cycle in order just after the absence of supply of power during an entirety of a positive half-cycle, and a second group of wave forms in which power is supplied in at least a part of a positive half-cycle just after the absence of supply of power during an entirety of a negative half-cycle, or both a first group of wave forms in which power is supplied in both at least a part of a positive half-cycle and at least a part of a negative half-cycle in order just after the absence of supply of power during an entirety of a negative half-cycle, and a second group of wave forms in which power is supplied in at least a part of a negative half-cycle just after the absence of supply of power during an entirety of a positive half-cycle.

12. An image forming apparatus according to claim 11, wherein the current detection circuit includes a circuit configured to detect the current including only one of the positive half-cycle and the negative half-cycle in the AC wave form.

13. An image forming apparatus according to claim 11, further comprising a low voltage DC power supply circuit which derives power from the AC power supply connected to a line branching from the power supply path from the AC power supply to the heater, wherein the current detection part detects the current flowing in the power supply path on an AC power supply side of a branch position between the heater and the low voltage DC power supply circuit.

14. An image forming apparatus according to claim 11, wherein half-cycles contributing to supply power in the first group of wave forms and the second group of wave forms are the wave number control pattern.

15. An image forming apparatus according to claim 11, wherein the fixing part further comprises an endless belt configured be heated by the heater.

16. An image forming apparatus according to claim 15, wherein the heater contacts with an inner surface of the endless belt.

17. An image forming apparatus according to claim 16, wherein the fixing part further comprises a pressure roller that forms a fixing nip portion for performing a fixing process on a recording material that bears the unfixed toner image together with the heater via the endless belt.

18. An image forming apparatus, comprising:

a fixing part configured to heat-fix an unfixed toner image formed on a recording material to the recording material, the fixing part comprising a heater that generates heat by power supplied from an AC power supply;

a temperature sensing element configured to sense a temperature of the fixing part;

a power control part configured to control the power supplied from the AC power supply to the heater in accordance with the temperature sensed by the temperature sensing element, the power control part comprising only one switching element for controlling the power supplied from the AC power supply to the heater, wherein the power control part controls the power supplied to the heater with control patterns depend on a combination of a phase control pattern and a wave number control pattern; and a current detection part provided in a power supply path from the AC power supply to the heater, configured to detect a current flowing in the heater, the current detection part comprising a transformer and a current detection circuit for detecting the current via the transformer, wherein a wave form of current flowing in the heater, controlled by the power control part includes:

both a first group of wave forms in which power is supplied in both at least a part of a negative half-cycle and at least a part of a positive half-cycle in order just after the absence of supply of power during an entirety of a positive half-cycle, and a second group of wave forms in which power is supplied in at least a part of a positive half-cycle just after the absence of supply of power during an entirety of a negative half-cycle, or both a first group of wave forms in which power is supplied in both at least a part of a positive half-cycle and at least a part of a negative half-cycle in order just after the absence of supply of power during an entirety of a negative half cycle, and a second group of wave forms in which power is supplied in at least a part of a negative half-cycle just after the absence of supply of power during an entirety of a positive half-cycle.

19. An image forming apparatus according to claim 18, wherein the current detection circuit includes a circuit configured to detect the current including only one of the positive half-cycle and the negative half-cycle in the AC wave form.

20. An image forming apparatus according to claim 18, further comprising a low voltage DC power supply circuit which derives power from the AC power supply connected to a line branching from the power supply path from the AC power supply to the heater, wherein the current detection part detects the current flowing in the power supply path on an AC power supply side of a branch position between the heater and the low voltage DC power supply circuit.

21. An image forming apparatus according to claim 18, wherein half-cycles contributing to supply power in the first group of wave forms and the second group of wave forms comprise the wave number control pattern.

22. An image forming apparatus according to claim 18, wherein the fixing part further comprises an endless belt configured be heated by the heater.

23. An image forming apparatus according to claim 22, wherein the heater contacts with an inner surface of the endless belt.

24. An image forming apparatus according to claim 23, wherein the fixing part further comprises a pressure roller that forms a fixing nip portion for performing a fixing process on a recording material that bears the unfixed toner image together with the heater via the endless belt.

* * * * *